US010403461B2

(12) United States Patent
Kobayashi et al.

(10) Patent No.: US 10,403,461 B2
(45) Date of Patent: Sep. 3, 2019

(54) ELECTROMAGNETIC RELAY

(71) Applicant: Panasonic Intellectual Property Management Co., Ltd., Osaka (JP)

(72) Inventors: Masakazu Kobayashi, Osaka (JP); Shinya Kimoto, Mie (JP); Kenji Kanematsu, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 106 days.

(21) Appl. No.: 15/571,043

(22) PCT Filed: Jun. 22, 2016

(86) PCT No.: PCT/JP2016/003003
§ 371 (c)(1),
(2) Date: Nov. 1, 2017

(87) PCT Pub. No.: WO2017/002330
PCT Pub. Date: Jan. 5, 2017

(65) Prior Publication Data

US 2018/0166244 A1 Jun. 14, 2018

(30) Foreign Application Priority Data

Jul. 1, 2015 (JP) ..... 2015-133101

(51) Int. Cl.
*H01H 71/24* (2006.01)
*H01H 50/36* (2006.01)
(Continued)

(52) U.S. Cl.
CPC ..... *H01H 71/2454* (2013.01); *H01H 50/02* (2013.01); *H01H 50/36* (2013.01);
(Continued)

(58) Field of Classification Search
CPC .... H01H 71/2454; H01H 50/42; H01H 50/44; H01H 50/54; H01H 50/02; H01H 71/32; H01H 50/645; H01H 50/36
See application file for complete search history.

(56) References Cited

U.S. PATENT DOCUMENTS 4,641,117 A * 2/1987 Willard ..... H01H 71/26 335/180
6,002,184 A * 12/1999 Delson ..... H02K 23/00 273/148 R (Continued)

FOREIGN PATENT DOCUMENTS

JP 57-163939 10/1982
WO WO-2015015761 A1 * 2/2015 ..... H01H 50/44

OTHER PUBLICATIONS

International Search Report of PCT application No. PCT/JP2016/003003 dated Aug. 16, 2016.

*Primary Examiner* — Mohamad A Musleh
(74) *Attorney, Agent, or Firm* — McDermott Will & Emery LLP

(57) ABSTRACT

An electromagnetic relay includes an electromagnet device, a contactor, and a trip device turning the contactor into an open state in which the contactor opens when an abnormal current flows. The electromagnet device includes a first excitation coil, a fixed element, first and second movable elements, and a permanent magnet. The contactor includes a fixed contact and a movable contact. In the electromagnetic relay, while the permanent magnet causes the first movable element to attractingly contact the second movable element, the fixed element attracts the first movable element due to a magnetic flux generated by the first excitation coil so as to move the second movable element together with the first movable element from a normal position to an attracted position. In the contactor, the movable contact moves, as the (Continued)

second movable element moves, so as to switch between a closed state in which the movable contact contacts the fixed contact and the open state in which the movable contact is removed from the fixed contact. The contactor is turned into the closed state when the second movable element is located at the attracted position. The trip device includes a second excitation coil connected in series to the contactor and a spring for acting a force on the second movable element in a direction away from the first movable element.

14 Claims, 18 Drawing Sheets

(51) Int. Cl.

| | |
|---|---|
| ***H01H 50/02*** | (2006.01) |
| ***H01H 50/44*** | (2006.01) |
| ***H01H 50/54*** | (2006.01) |
| ***H01H 50/64*** | (2006.01) |
| ***H01H 71/32*** | (2006.01) |
| ***H01H 50/42*** | (2006.01) |

(52) U.S. Cl.
CPC ..... *H01H 50/42* (2013.01); *H01H 50/44* (2013.01); *H01H 50/54* (2013.01); *H01H 50/645* (2013.01); *H01H 71/32* (2013.01); *H01H 2235/01* (2013.01)

(56) References Cited

U.S. PATENT DOCUMENTS

| | | | | |
|---|---|---|---|---|
| 7,557,681 | B2 * | 7/2009 | Whitaker | H01H 71/0228 335/14 |
| 7,605,680 | B2 * | 10/2009 | Matsumoto | H01F 7/081 335/103 |
| 8,179,217 | B2 * | 5/2012 | Kawaguchi | H01F 7/1615 335/124 |
| 2003/0235021 | A1 * | 12/2003 | Siedelhofer | H01H 71/142 361/102 |

* cited by examiner

ELECTROMAGNETIC RELAY

This application is a U.S. national stage application of the PCT International Application No. PCT/JP2016/003003 filed on Jun. 22, 2016, which claims the benefit of foreign priority of Japanese patent application 2015-133101 filed on Jul. 1, 2015, the contents all of which are incorporated herein by reference.

TECHNICAL FIELD

The present invention relates to an electromagnetic relay that opens and closes a contactor by using an electromagnet device.

BACKGROUND ART

PTL 1 discloses an electromagnetic relay including a coil for attractingly driving a movable element (a plunger), and a permanent magnet disposed opposite to the movable element. The permanent magnet attractingly holds the movable element. When the movable element is attracted toward a permanent magnet, the contactor is turned on (closed). In the electromagnetic relay, when a voltage is applied to the coil, the movable element is moved. The movement turns on the contactor. Even if excitation of the coil is released, the movable element is held by a magnetic flux of the permanent magnet, thereby maintaining the turning-on of the contactor.

In the electromagnetic relay disclosed in PTL 1, an overcurrent detection coil is provided in an electric circuit including the contactor. When an abnormal current, such as overcurrent or a short-circuit current, flows into the contactor, the electromagnetic relay moves the movable element in a direction opposite to the permanent magnet by using the overcurrent detection coil and turns off (opens) the contactor. Thus, the electromagnetic relay uses a magnetic flux generated when abnormal current flows to drive the movable element such that the movable element is forced to return. This configuration can detect the occurrence of the abnormal current quickly, and cut an electric path rapidly.

CITATION LIST

Patent Literature

PTL 1: Japanese Patent Laid-Open Publication No. 57-163939

SUMMARY

An electromagnetic relay includes an electromagnet device, a contactor, and a trip device turning the contactor into an open state in which the contactor opens when an abnormal current flows. The electromagnet device includes a first excitation coil, a fixed element, first and second movable elements, and a permanent magnet. The contactor includes a fixed contact and a movable contact. In the electromagnetic relay, while the permanent magnet causes the first movable element to attractingly contact the second movable element, the fixed element attracts the first movable element due to a magnetic flux generated by the first excitation coil so as to move the second movable element together with the first movable element from a normal position to an attracted position. In the contactor, the movable contact moves, as the second movable element moves, so as to switch between a closed state in which the movable contact contacts the fixed contact and the open state in which the movable contact is removed from the fixed contact. The contactor is turned into the closed state when the second movable element is located at the attracted position. The trip device includes a second excitation coil connected in series to the contactor and a spring for acting a force on the second movable element in a direction away from the first movable element.

The electromagnetic relay maintains the contactor in the open state when abnormal current flows into the contactor.

DETAIL DESCRIPTION OF EMBODIMENTS

Exemplary Embodiment 1

(1.1) Summary

Figure 1:
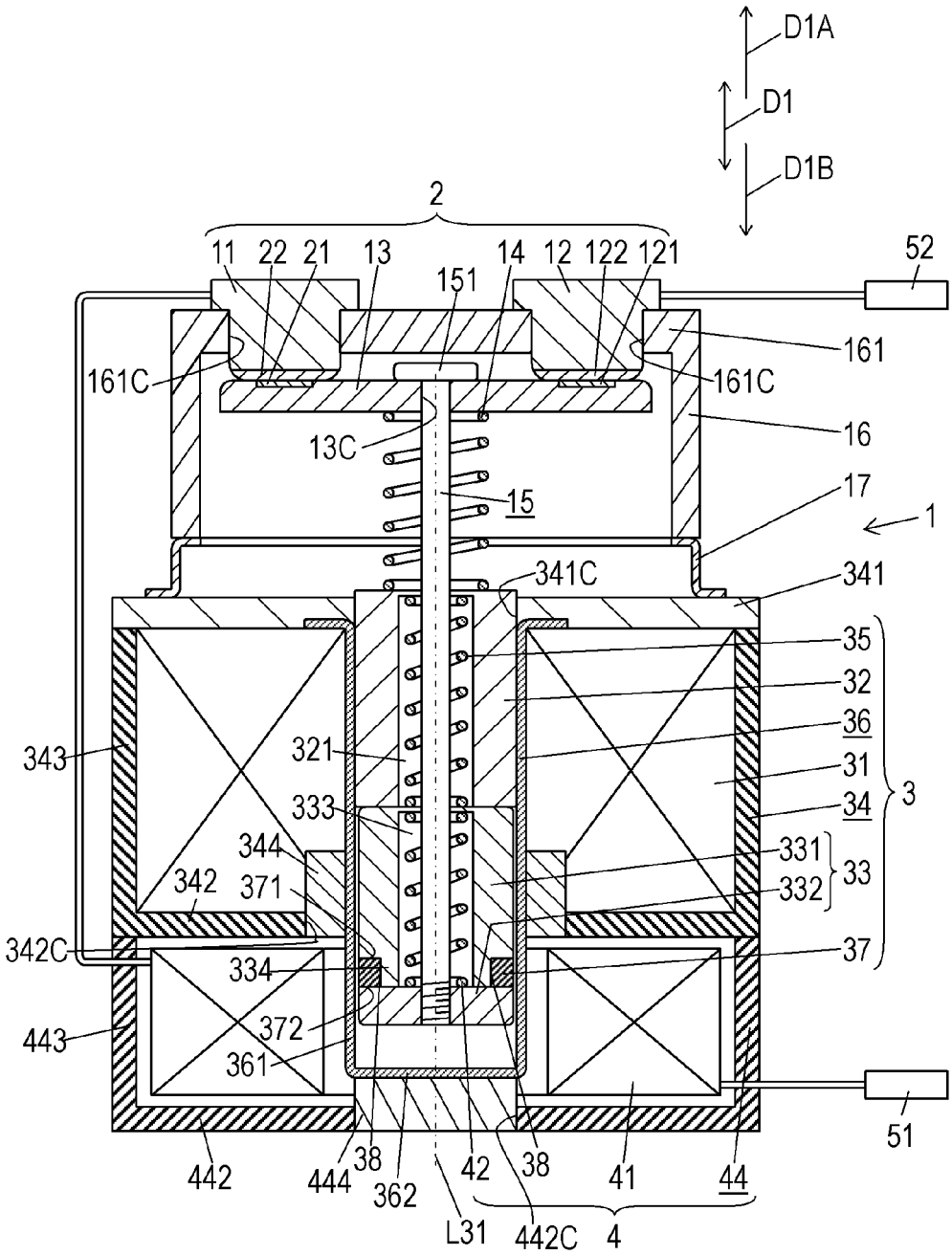
FIG. 1 is a schematic cross-sectional view of an electromagnetic relay in accordance with Exemplary Embodiment 1 for illustrating an ON state thereof.

FIG. 1 is a schematic cross-sectional view of electromagnetic relay 1 in accordance with Exemplary Embodiment 1. Electromagnetic relay 1 includes contactor 2, electromagnet device 3, and trip device 4.

Electromagnet device 3 includes excitation coil 31, fixed element 32, movable element 331, movable element 332, and permanent magnet 37. While permanent magnet 37 causes movable element 331 to attractingly contact movable element 331, electromagnet device 3 uses a magnetic flux generated by excitation coil 31 to attract movable element 331 toward fixed element 32 so as to move movable element 332 together with movable element 331 from a normal position to an attracted position.

Contactor 2 includes fixed contacts 22 and 122 and movable contacts 21 and 121. Contactor 2 is configured to switch between a closed state in which movable contacts 21 and 121 contact fixed contacts 22 and 122, respectively, and an open state in which movable contacts 21 and 121 are removed from fixed contacts 22 and 122, respectively, by moving movable contact 21 and 121 as movable element 332 moves. When movable element 332 is located at the attracted position, contactor 2 is turned in the closed state.

Trip device 4 includes excitation coil 41 and spring 42. Excitation coil 41 is connected in series to contactor 2. Spring 42 acts a force on movable element 332 in a direction away from movable element 331. When movable element 332 is located at the attracted position and an abnormal current equal to or larger than a predetermined flows into excitation coil 41, trip device 4 releases the attracting contact of movable element 332 by permanent magnet 37 by using the magnetic flux generated excitation coil 41. When the attracting contact of movable element 332 is released, trip device 4 moves movable element 332 by using spring 42, so that contactor 2 is turned into the open state. On the other hand, when movable element 332 is located at the attracted position and a normal current smaller than the predetermined value flows into excitation coil 41, trip device 4 does not release the attracting contact of movable element 332 by permanent magnet 37, and attracts movable element 332 toward permanent magnet 37 by using the magnetic flux generated by excitation coil 41.

Note that, the term, "attractingly contact", which means that one device attracts and contacts another device, includes that one device attracts and not only directly contacts another device but also indirectly contacts another device. In other words, the state where movable element 331 attractingly contacts movable element 332 includes not only the state where movable element 332 contacts movable element 331 but also the state where movable element 332 contacts movable element 331 via, e.g. permanent magnet 37. The state where movable element 331 attractingly contacts movable element 332 thus includes the state where movable element 332 moves toward movable element 331.

In short, when an abnormal current does not flow into contactor 2 (in a normal time), electromagnetic relay 1 in accordance with the embodiment is in the state where permanent magnet 37 causes movable element 331 to attractingly contact movable element 331 such that movable element 331 and movable element 332 unitarily constitute a single substance. In this state, when excitation coil 31 is energized to attract movable element 331 toward fixed element 32, movable element 332 moves together with movable element 331 to move from the normal position to the attracted position, thereby turning contactor 2 into the closed state.

While movable element 332 is located at the attracted position, if the abnormal current flows into contactor 2 in the closed state, trip device 4 is activated to release the attracting contact of movable element 332 by permanent magnet 37 by using the magnetic flux generated by excitation coil 41. Thus, spring 42 moves movable element 332 in a direction away from movable element 331, thereby turning contactor 2 into the open state. In other words, when the abnormal current flows, trip device 4 removes movable element 332 away from movable element 331. Movable element 332 thus moves to turn contactor 2 into the open state. After trip device 4 is activated, a force of spring 42 acts on movable element 332 to continuously remove movable element 332 from movable element 331.

In the electromagnetic relay described in PTL 1, when an abnormal current flows into the contactor and the contactor is turned off (opened), a driving force of the overcurrent detection coil is released, thereby allowing a magnetic flux generated by the coil to cause the movable element to be attracted toward the permanent magnet, so that the contactor may be turned on (closed) again. In other words, when the abnormal current flows in the electromagnetic relay, the contactor may be turned on again after the contactor is turned off, i.e., is in the open state.

In electromagnetic relay 1 in accordance with Embodiment 1, after trip device 4 is activated to turn contactor 2 into the open state, movable element 332 continuously removed away from movable element 331 even if the driving force of excitation coil 41 is released. As a result, even if movable element 331 attractingly contact fixed element 32 due to the magnetic flux generated by excitation coil 31, movable element 332 does not return back to the attracted position, so that contactor 2 can be maintained in the open state. Therefore, electromagnetic relay 1 can maintain contactor 2 in the open state advantageously when the abnormal current flows into contactor 2.

(1.2) Basic Structure of the Electromagnetic Relay

Electromagnetic relay 1 in accordance with the embodiment will be detail below. Electromagnetic relay 1 described below merely represents an example of the present invention. Therefore, the present invention is not limited to the following exemplary embodiments and may be modified variously without departing from the scope of the present invention, even if not including the exemplary embodiments, according to a design or the like.

Figure 2:
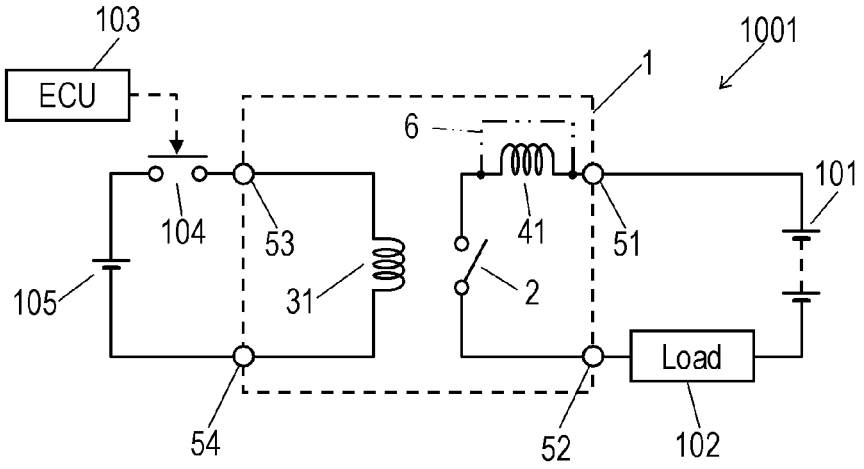
FIG. 2 is a schematic circuit diagram of the electromagnetic relay in accordance with Embodiment 1.

FIG. 2 is a schematic circuit diagram of apparatus 1001 including electromagnetic relay 1. In accordance with the embodiment, apparatus 1001 is an electric vehicle (EV). As shown in FIG. 2, electromagnetic relay 1 is used such that contactor 2 is inserted in a path for supplying direct current power to load 102, such as an inverter, from drive battery 101. Excitation coil 31 of electromagnetic relay 1 is connected to excitation power source 105 via switching element 104 for switching between turning on and off in response to a control signals from electronic control unit (ECU) 103 of the electric vehicle. Thus, electromagnetic relay 1 opens and closes contactor 2 in response to the control signal from ECU 103, and switch the state of direct current power supplied to load 102 from drive battery 101.

In accordance with the embodiment, as shown in FIG. 1, contactor 2 includes a pair of fixed contacts 22 and 122, a pair of movable contacts 21 and 121, a pair of contact bases 11 and 12 for supporting fixed contacts 22 and 122, respectively, movable contact base 13 for supporting movable contacts 21 and 121, and contact-pressure spring 14 for securing a contact pressure causing movable contacts 21 and 121 to contact fixed contacts 22 and 122, respectively. Contactor 2 includes the pair of fixed contacts 22 and 122 and the pair of movable contacts 21 and 121. The structure of contactor 2 will be detail later, When contactor 2 is in the closed state, contact bases 11 and 12 are short-circuited via movable contact base 13. Thus, contactor 2 is inserted between drive battery 101 (see FIG. 2) and load 102, such that the direct current power from drive battery 101 is supplied to load 102 (see FIG. 2) via the pair of contact bases 11 and 12 and movable contact base 13. Contactor 2 is connected in series to load 102 between output terminals of battery 101, but may be inserted between load 102 and a negative electrode (negative pole) of battery 101.

As shown in FIG. 1, electromagnetic relay 1 in accordance with the embodiment further includes shaft 15, case 16, and coupler 17 in addition to contactor 2, electromagnet device 3, and trip device 4 which are mentioned above. Electromagnetic relay 1 further includes a pair of output terminals 51 and 52 inserted in a path through which the direct current power is supplied from drive battery 101 (see FIG. 2) to load 102 (see FIG. 2), and a pair of input terminals 53 and 54 (see FIG. 2) connected to excitation power source 105.

Electromagnet device 3 further includes yoke 34, restoring spring 35, and tubular body 36 in addition to excitation coil 31, fixed element 32, movable element 331, movable element 332, and permanent magnet 37. Movable elements 331 and 332 attractingly contact each other due to permanent magnet 37 to form a single substance collectively, thus constituting movable element block 33. In other words, even if there is no otherwise specified, movable element block 33 indicates the state where movable elements 331 and 332 are unified. Electromagnet device 3 may include a coil bobbin made of synthetic resin and excitation coil 31 wound around the coil bobbin.

Yoke 34 together with fixed element 32 and movable element block 33 forms a magnetic path through which a magnetic flux generated by energized excitation coil 31 passes. Therefore, yoke 34, fixed element 32, and movable element block 33 (i.e., movable element 331 and movable element 332) are made of magnetic material.

In accordance with the embodiment, yoke 34 includes upper yoke plate 341 and lower yoke plate 342 that are provided at both sides of excitation coil 31 in a direction of center axis L31 face each other across excitation coil 31. In the following description, directions along center axis L31 of excitation coil 31 are defined as upward and downward directions D1. A direction from excitation coil 31 toward upper yoke plate 341 is defined as upward direction D1A. A direction from excitation coil 31 toward lower yoke plate 342 is defined as downward direction D1B. However, these directions do not limit directions of electromagnetic relay 1 upon being used.

Yoke 34 further includes side yoke plates 343 and bush 344. Each of side yoke plates 343 connects respective one of peripheral edges of upper yoke plate 341 to respective one of peripheral edges of lower yoke plate 342. Bush 344 has a cylindrical shape and projects from a center portion of an upper surface of lower yoke plate 342 toward upward direction D1A. Upper yoke plate 341 and lower yoke plate 342 have rectangular plate shapes. Each of side yoke plates 343 connects respective one of sides of a lower surface of upper yoke plate 341 opposite to each other and to respective one of sides of the upper surface of lower yoke plate 342 opposite to each other. Side yoke plates 343 and lower yoke plate 342 are unitarily made of a plate continuously extending. Holding aperture 342C is formed in the center portion of lower yoke plate 342. A bottom end of bush 344 is fitted into holding aperture 342C of lower yoke plate 342.

Excitation coil 31 is disposed in a space surrounded by upper yoke plate 341, lower yoke plate 342, and side yoke plates 343. Bush 344, fixed element 32, and movable element 331 are disposed inside excitation coil 31. Each of both ends of excitation coil 31 is connected to respective one of input terminals 53 and 54 (see FIG. 2).

Fixed element 32 is a fixed ferromagnetic core having a cylindrical shape projecting in downward direction D1B from the center portion of the lower surface of upper yoke plate 341. An upper end of fixed element 32 is fixed to yoke 34 (upper yoke plate 341). Fitting aperture 341C is formed in the center portion of upper yoke plate 341. The upper end of fixed element 32 is fitted into fitting aperture 341C of upper yoke plate 341. Fixed element 32 has an outer diameter smaller than an inner diameter of bush 344. A gap is provided between a lower end surface of fixed element 32 and an upper end surface of bush 344 in upward and downward directions D1 (a longitudinal direction).

Movable element 331 is a movable ferromagnetic core having a cylindrical shape. Movable element 331 is disposed below fixed element 32 such that an upper end surface of movable element 331 faces the lower end surface of fixed element 32. An outer diameter of movable element 331 is substantially identical to an outer diameter of fixed element 32, i.e., smaller than the inner diameter of bush 344.

Movable element 332 is a movable ferromagnetic core having a disc shape. Movable element 332 is disposed below movable element 331 such that an upper end surface of movable element 332 faces a lower end surface of movable element 331. An outer diameter of movable element 332 is substantially identical to the outer diameter of movable element 331.

Movable element 332 together with movable element 331 forms a magnetic path through which the magnetic flux generated by permanent magnet 37 passes. Accordingly, the magnetic flux generated by permanent magnet 37 passes through movable elements 331 and 332, thereby holding movable element 332 on movable element 331 while movable element 332 is attracted to movable element 331. In other words, permanent magnet 37 causes movable element 332 to attractingly contacts movable element 331 and to be integrated with movable element 331, thus constituting movable element block 33.

Movable element block 33 moves along an inner circumferential surface of bush 344 inside bush 344 in upward and downward directions D1 (the longitudinal direction). In other words, movable element block 33 is movable between a contact position at which the upper end surface of movable element 331 contacts the lower end surface of fixed element 32 and a removed position at which the upper end surface of movable element 331 is removed away from the lower end surface of fixed element 32. When movable element block 33 is located at the contact position, movable element 332 is located at an attracted position. When movable element block 33 is located at the removed position, movable element 332 is positioned at a normal position. In accordance with the embodiment, movable element 332 of movable element block 33 can move to a lower limit position below the normal position, which will be described later.

Spring 42 of trip device 4 is disposed inside movable element 331. An upper end of movable element 331 has an inner diameter smaller than an inner diameter of any portion of movable element 331 other than the upper end of movable element 331. In other words, the inner diameter of movable element 331 locally decreases at the upper end of movable element 331. In movable element 331 having the above configuration, an inside of the portion of movable element 331 other than the upper end of movable element 331 constitutes accommodation space 333 accommodating spring 42 therein. Spring 42 is thus accommodated in accommodation space 333 while being compressed while movable element 331 attractingly contacts movable element 332. Therefore, a force of spring 42 acts on movable element 332 in downward direction D1B away from movable element 331 while movable element 332 contacts movable element 331 to be unified with movable element 331.

The force acting on movable element 332 from spring 42 while movable element 332 is unified with movable element 331 is smaller than a force of permanent magnet 37 for attracting movable element 332 toward movable element 331. Accordingly, while the force from spring 42 acts on movable element 332, movable element 332 attractingly contacts movable element 331 continuously, that is, movable element 332 is continuously unified with movable element 331.

According to the embodiment, permanent magnet 37 is provided at movable element 331. In the example shown in FIG. 1, permanent magnet 37 is provided on the lower end surface of movable element 331. Magnetic-path portion 334 is provided in movable element 331. Magnetic-path portion 334 together with movable elements 331 and 332 forms a closed magnetic path through which the magnetic flux generated by permanent magnet 37 passes. Magnetic-path portion 334 has an annular shape, and projects in downward direction D1B from a peripheral edge of an opening of accommodation space 333 which is located on the lower end surface of movable element 331. Permanent magnet 37 has an annular shape concentric with magnetic-path portion 334, and is disposed outside magnetic-path portion 334. In other words, magnetic-path portion 334 is inserted into a hollow of permanent magnet 37, i.e., a space surrounded by an inner circumferential surface of permanent magnet 37, and permanent magnet 37 is thus attached to movable element 331.

Permanent magnet 37 has magnetic pole surfaces 371 and 372 arranged in upward and downward directions D1 and having polarities different from each other. Magnetic pole surface 371 is directed to upward direction D1A while magnetic pole surface 372 is directed to downward direction D1B. As shown in FIG. 1, the magnetic flux generated by permanent magnet 37 passes through movable element 331, magnetic-path portion 334, and movable element 332 while movable element 332 is unified with movable element 331. According to the embodiment, magnetic pole surface 372 functions as an S-pole while magnetic pole surface 371 functions as an N-pole, but not limited to this configuration. The N pole and the S pole may be reversed.

Short-circuit prevention portion 38 made of nonmagnetic material is provided between permanent magnet 37 and magnetic-path portion 334. Short-circuit prevention portion 38 is formed by a plating layer that is formed on the inner circumferential surface of permanent magnet 37 or an outer circumferential surface of magnetic-path portion 334. Short-circuit prevention portion 38 prevents permanent magnet 37 from directly contacting magnetic-path portion 334. This configuration prevents the magnetic flux from short-circuiting between magnetic pole surface 371 and magnetic pole surface 372 through the surface of magnetic-path portion 334 contacting permanent magnet 37.

Restoring spring 35 is disposed inside fixed element 32, and is a coil spring for urging movable element block 33 in downward direction D1B toward the removed position. An upper end of fixed element 32 has an inner diameter smaller than an inner diameter of a portion of fixed element 32 other than the upper end of fixed element 32. In other words, the inner diameter of fixed element 32 locally decreases at the upper end of fixed element 32. Accommodation space 321 for accommodating restoring spring 35 therein is constituted by the inner side of the portion of fixed element 32 other than the upper end of fixed element 32. Accordingly, restoring spring 35 is accommodated in accommodation space 321 while being compressed when movable element block 33 is attracted toward fixed element 32 and moved to the contact position from the removed position. Thus, movable element block 33 (movable element 331) can contact fixed element 32.

Tubular body 36 accommodates movable element block 33 and fixed element 32 therein. Tubular body 36 has tubular part 361 having two openings and bottom plate 362 for closing one of the two openings of tubular part 361. Movable element block 33 and fixed element 32 are arranged in the upward direction or the downward direction (one direction) out of upward and downward directions D1 such that movable element block 33 is located closer to bottom plate 362 than fixed element 32 is, and disposed inside tubular part 361. In other words, fixed element 32, movable element 331, and movable element 332 are arranged in this order from above (in one direction) out of upward and downward directions D1.

In detail, according to the embodiment, tubular body 36 is made of nonmagnetic material. Tubular body 36 has tubular part 361 having a cylindrical shape and bottom plate 362 having a circular shape to form a closed cylindrical shape, as a whole, having an opening upper surface. Tubular body 36 accommodates fixed element 32 and movable element block 33 therein. An upper end (opening periphery) of tubular body 36 is fixed to upper yoke plate 341 while a lower portion of tubular body 36 is fitted into the inside of bush 344. A depth of tubular body 36, i.e., a length of the tubular part in upward and downward directions D1 is determined such that a distance from bottom plate 362 to the lower end surface of fixed element 32 is sufficiently larger than a length of movable element block 33 in upward and downward directions D1. In accordance with the embodiment, the depth of tubular body 36 is determined to produce a gap between bottom plate 362 and the lower end surface of movable element block 33 while movable element block 33 is removed away from fixed element 32, i.e., while movable element block 33 is located at the removed position. In other words, while movable element 332 is located at the normal position, a gap is provided between bottom plates 362 and the lower end surface of movable element 332.

This configuration allows movable element 332 to move from the attracted position to the lower limit position through the normal position in tubular body 36. Tubular body 36 restricts movable element block 33 to move in upward and downward directions D1 (the longitudinal direction) and determines the lower limit position of movable element 332.

In electromagnet device 3, excitation coil 31, bush 344, fixed element 32, and movable element block 33 all have center axes aligned to a single straight line along upward and downward directions D1.

When excitation coil 31 is not energized (i.e., excitation coil 31 is de-energized), a magnetic attraction force is not generated between movable element block 33 and fixed elements 32, so that movable element block 33 is placed at the removed position due to a spring force of restoring spring 35. On the other hand, when excitation coil 31 is energized, the magnetic attraction force is generated between movable element block 33 and fixed elements 32. This configuration causes movable element block 33 to be attracted in upward direction D1A to move to the contact position while resisting against the spring force of restoring spring 35.

In other words, upon being energized, excitation coil 31 generates a magnetic flux. This magnetic flux causes electromagnet device 3 to move movable element block 33 so as to reduce a magnetic resistance of the magnetic circuit formed by yoke 34, fixed element 32, and movable element block 33. When excitation coil 31 is energized, electromagnet device 3 moves movable element block 33 from the removed position to the contact position such that the gap between the lower end surface of fixed element 32 and the upper end surface of bush 344 which serve as a part of the magnetic circuit is filled with movable element block 33. At this moment, movable element 332 moves from the normal position to the attracted position while moving together with movable element 331.

On the other hand, when the energization of excitation coil 31 is stopped, electromagnet device 3 moves movable element block 33 from the contact position to the removed position due to the spring force of restoring spring 35. At this moment, movable element 332 moves from the attracted position to the normal position while moving together with movable element 331.

In short, when excitation coil 31 is energized, electromagnet device 3 attracts movable element 331 toward fixed element 32 due to the magnetic flux generated by excitation coil 31, and moves movable element 332 from the normal position to the attracted position. While excitation coil 31 is continuously energized, electromagnet device 3 continuously generates an attraction force between fixed element 32 and movable element 331. This configuration holds movable element 332 at the attracted position as long as movable element 331 attractingly contacts movable element 331.

By switching the energized state of excitation coil 31, electromagnet device 3 thus controls the attraction force acting on movable element block 33 and moves movable element 332 in upward and downward directions D1, thereby obtaining a driving force for switching between the open state and the closed state of contactor 2.

When excitation coil 31 is de-energized, movable element 332 is placed at the normal position located at the middle position of a movable range, but not at the lower limit position located at a lower end of the movable range. This is because the spring force of restoring spring 35 and the spring force of contact-pressure spring 14 are balanced. In other words, the spring force of restoring spring 35 acts on movable element block 33 downward while the spring force of contact-pressure spring 14, described later, acts on movable element block 33 upward through movable contact base 13 and shaft 15. Accordingly, when excitation coil 31 is de-energized, movable element block 33 stops at the removed position where the force from restoring spring 35 acting on the movable element block 33 and the force from contact-pressure spring 14 acting on movable element block 33 are balanced. Consequently, movable element 332 stops at the normal position.

Contact bases 11 and 12 of contactor 2 are disposed above electromagnet device 3 such that contact bases 11 and 12 is arranged in a direction along a plane crossing upward and downward directions D1 perpendicularly. Each of contact bases 11 and 12 has a circular columnar shape having a circular cross section in the plane. The positional relationship of contact bases 11 and 12 with respect to yoke 34 and fixed element 32 of electromagnet device 3 is fixed.

Contact bases 11 and 12 are fixed to case 16 joined to yoke 34. Case 16 has a box shape having an opening in a lower surface thereof, and accommodates fixed contact 22 and movable contact 21 between upper yoke plate 341 and case 16. Case 16 is made of, e.g. heat-resistant material, such as ceramics. A periphery of the opening of case 16 is joined to a peripheral edge portion of the upper surface of upper yoke plate 341 via coupler 17. Contact bases 11 and 12 are inserted into circular holes 161C provided in bottom plate 161 (upper wall) of case 16, and joined to case 16.

Case 16, coupler 17, upper yoke plate 341, and tubular body 36 preferably constitute an airtight, hermetic container for forming an airtight space therein. In this case, arc-extinguishing gas based on hydrogen preferably fills the airtight container. If an arc occurs when movable contacts 21 and 121 are removed away from fixed contacts 22 and 122 accommodated in the airtight container, the arc-extinguishing gas cools the arc quickly and can extinguish the arc rapidly. However, fixed contact 22 and movable contact 21 may not necessarily be accommodated in the airtight container.

Contact bases 11 and 12 are made of conductive material. Each of fixed contacts 22 and 122 is formed on respective one of lower ends of contact bases 11 and 12. Upper ends of contact bases 11 and 12 have outer diameters larger than outer diameters of portions of contact bases 11 and 12 other than the upper ends of contact bases 11 and 12. In other words, outer diameters of contact bases 11 and 12 locally increase at the upper ends of contact bases 11 and 12. Output terminal 51 is connected to the upper end of contact base 11 out of contact bases 11 and 12 via excitation coil 41. On the other hand, output terminal 52 is connected to the upper end of contact base 12 out of contact bases 11 and 12. In other words, excitation coil 41 of trip device 4 is inserted between contact base 11 and output terminal 51. In short, excitation coil 41 is connected in series to contactor 2 and between output terminals 51 and 52, as shown in FIG. 2.

Movable contact base 13 is made of conductive material, and has a rectangular plate shape. Movable contact base 13 is disposed below the pair of contact bases 11 and 12 such that each of both ends of the rectangular shape of movable contact base 13 in a longitudinal direction faces respective one of the lower ends of contact bases 11 and 12. In movable contact base 13, each of movable contacts 21 and 121 is provided at respective one of portions facing respective one of fixed contacts 22 and 122 provided on contact bases 11 and 12.

Movable contact base 13 is driven such that movable contact base 13 is moved in upward and downward directions D1 by electromagnet device 3. Thus, movable contacts 21 and 121 provided on movable contact base 13 move between a closed position in which each of movable contacts 21 and 121 contacts respective one of fixed contacts 22 and 122 and an open position in which movable contacts 21 and 121 are removed away from fixed contacts 22 and 122. When movable contacts 21 and 121 are located in the closed position, i.e., when contactor 2 is closed, contact base 11 and contact base 12 are short-circuited through movable contact base 13. Accordingly, while contactor 2 is closed, a current flows between output terminal 51 and output terminal 52 through excitation coil 41, and direct current power is supplied to load 102 from drive battery 101 through excitation coil 41.

Contact-pressure spring 14 disposed between fixed element 32 and movable contact base 13 is a coil spring for urging movable contact base 13 toward upward direction D1A. A spring force of contact-pressure spring 14 is smaller than a spring force of restoring spring 35.

Shaft 15 is made of nonmagnetic material and has a round bar shape extending in upward and downward directions D1. Shaft 15 transfers a driving force generated by electromagnet device 3 to contactor 2 provided above electromagnet device 3. Flange 151 is provided at an upper end of shaft 15 and has an outer diameter larger than an outer diameter of any portion end of shaft 15 other than the upper end of shaft 15. In other words, the outer diameter of shaft 15 increases locally at flange 151. Through-hole 13C is provided in a center portion of movable contact base 13, and has a diameter smaller than the outer diameter of flange 151 of shaft 15. Shaft 15 is inserted into through-hole 13C of movable contact base 13 such that flange 151 contacts the upper surface of movable contact base 13 at a periphery of through-hole 13C. Shaft 15 passes through the inside of contact-pressure spring 14, fixed element 32, restoring spring 35, movable element 331, and spring 42. A lower end of shaft 15 is fixed to movable element 332.

The above-described configuration allows the driving force generated by electromagnet device 3 to be transferred to movable contact base 13 via shaft 15, and accordingly allows movable contact base 13 to move in upward and downward directions D1 as movable element 332 moves in upward and downward directions D1.

(1.3) Basic Operation of Electromagnetic Relay 1

A basic operation of electromagnetic relay 1 with the above-mentioned structure will be described briefly below. This section will describe an operation of electromagnetic relay 1 in a normal time when an abnormal current equal to or larger than the predetermined value does not flow into contactor 2, i.e., when trip device 4 is not activated and movable element 331 is unified with movable element 332. In the normal time, a normal current smaller than the predetermined value flows into contactor 2, or a current does not flow into contactor 2.

Figure 3:
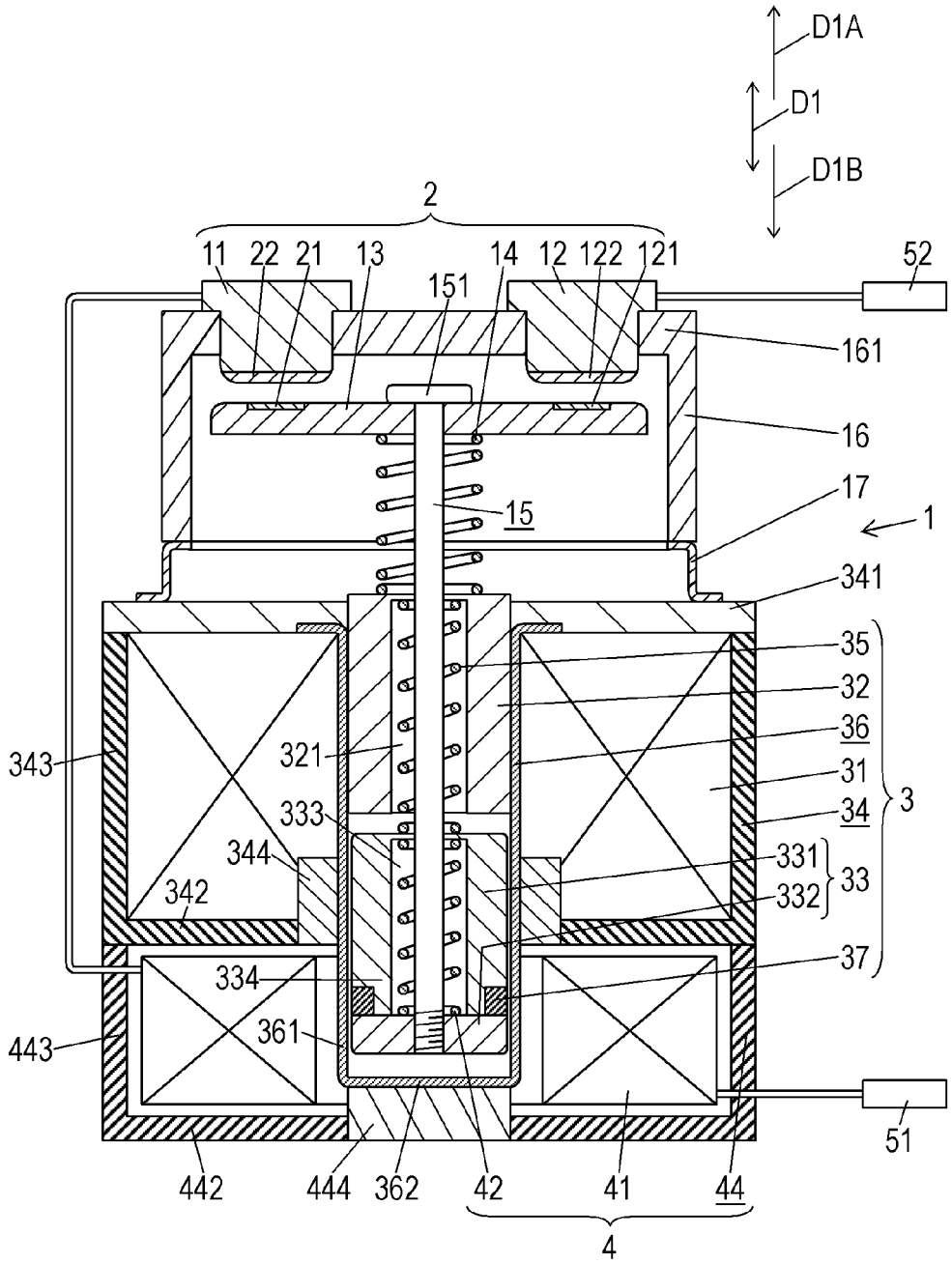
FIG. 3 is a schematic cross-sectional view of the electromagnetic relay in accordance with Embodiment 1 for illustrating an OFF state thereof.

FIG. 3 is a schematic cross-sectional view of electromagnetic relay 1 for illustrating the state where excitation coil 31 is de-energized, i.e., the state (hereinafter, referred to as "an OFF state") where movable contacts 21 and 121 are removed away from fixed contacts 22 and 122. FIG. 1 shows the state where excitation coil 31 is energized, i.e., the state (hereinafter, referred to as "ON state") where movable contacts 21 and 121 contact fixed contacts 22 and 122, respectively. In the OFF state, movable element block 33 of electromagnet device 3 is placed at the removed position, and movable element 332 is placed at the normal position. Accordingly, shaft 15 is pulled down in downward direction D1B by electromagnet device 3. At this moment, flange 151 provided at the upper end of shaft 15 presses down movable contact base 13 in downward direction D1B. This configuration allows flange 151 of shaft 15 to restrict movable contact base 13 to move in upward direction D1A, and to place movable contacts 21 and 121 in the open position away from fixed contacts 22 and 122. Therefore, in the OFF state, contactor 2 is opened. As a result, no current flows between contact bases 11 and 12, and thus, no current flows between output terminals 51 and 52.

Figure 4:
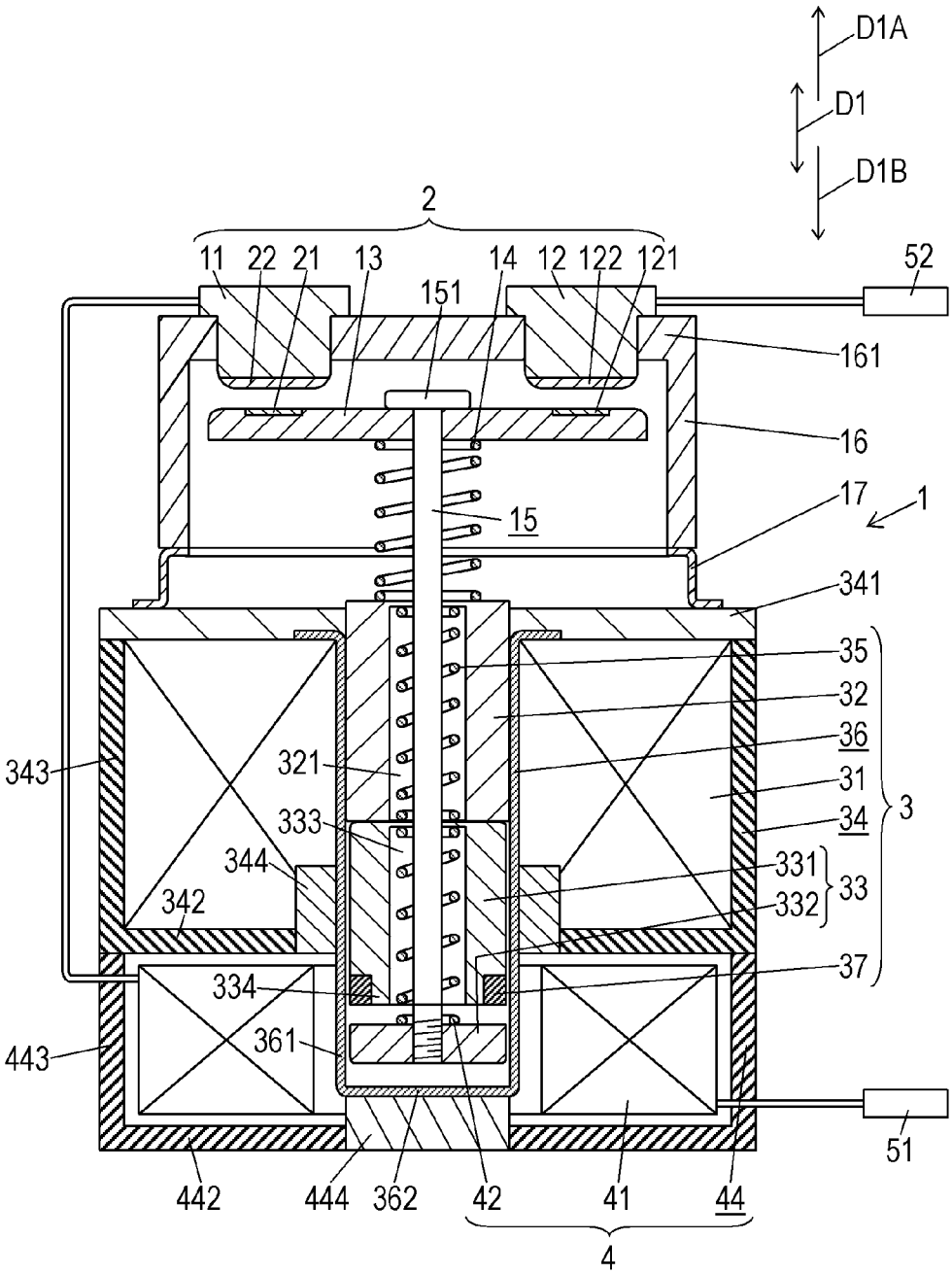
FIG. 4 is a schematic cross-sectional view of the electromagnetic relay in accordance with Embodiment 1 while a trip device is activated.

Even while trip device 4 is activated to remove movable element 332 away from movable element 331, as shown in FIG. 4, shaft 15 is pulled down in downward direction D1B by electromagnet device 3 similarly to in the OFF state. Accordingly, movable contact base 13 places movable contacts 21 and 121 in the open position away from fixed contacts 22 and 122, so that contactor 2 is opened. This will be detailed later.

On the other hand, FIG. 1 shows electromagnetic relay 1 when excitation coil 31 is energized, i.e., in the state (hereinafter, referred to as "an ON state") where movable contacts 21 and 121 contact fixed contacts 22 and 122, respectively. In the ON state, movable element block 33 of electromagnet device 3 is placed at the contact position, and movable element 332 is placed at the attracted position. This configuration allows electromagnet device 3 to press up shaft 15 in upward direction D1A. At this moment, flange 151 provided at the upper end of shaft 15 is moved in upward direction D1A, and releases the movement restriction in upward direction D1A, thereby allowing the spring force of contact-pressure spring 14 to press movable contact base 13 in upward direction D1A. Movable contact base 13 places movable contacts 21 and 121 in the closed position in which movable contacts 21 and 121 contact fixed contacts 22 and 122, respectively.

At this moment, shaft 15 has an appropriate overrun range to allow shaft 15 to be is further pressed up after movable contacts 21 and 121 contact fixed contacts 22 and 122, respectively. Contact-pressure spring 14 urges movable contact base 13 in upward direction D1A, thereby ensuring a pressure (contact pressure) between each of movable contacts 21 and 121 and respective one of fixed contacts 22 and 122. Therefore, in the ON state, i.e., when contactor 2 is located at the closed state, a current flows between contact bases 11 and 12. Consequently, a current flows between output terminals 51 and 52.

(1.4) Structure and Operation of Trip Device 4

A structure of trip device 4 will be described below. FIG. 4 is a schematic cross-sectional view of electromagnetic relay 1 showing the state where trip device 4 operates.

Trip device 4 includes excitation coil 41 and spring 42. Excitation coil 41 is connected in series to contactor 2. Spring 42 acts a force on movable element 332 in a direction away from movable element 331. When movable element 332 is located at the attracted position and an abnormal current equal to or larger than the predetermined value flows into excitation coil 41, trip device 4 releases the attracting contact of movable element 332 caused by permanent magnet 37 by using the magnetic flux generated by excitation coil 41. When the attracting contact of movable element 332 is released, spring 42 moves movable element 332, and turns contactor 2 into the open state, as shown in FIG. 4.

In other words, when movable element block 33 is located at the contact position, i.e., when movable element 332 is located at the attracted position, contactor 2 is turned in the closed state. Accordingly, a current flows into excitation coil 41 via contactor 2. If an abnormal current equal to or larger than the predetermined value flows into excitation coil 41 via contactor 2, trip device 4 is activated. When trip device 4 is activated, the attracting contact of movable element 332 caused by permanent magnet 37 is released by the magnetic flux generated by excitation coil 41. Accordingly, the force from spring 42 acting on movable element 332 in downward direction D1B causes movable element 332 to move in a direction away from movable element 331, and movable element 332 is thus removed away from movable element 331. At this moment, as movable element 332 moves away from movable element 331, shaft 15 is pulled down in downward direction D1B. Thus, movable contact base 13 places movable contacts 21 and 121 at the open position away from fixed contacts 22 and 122, thus turning contactor 2 into the open state.

Trip device 4 thus releases the attracting contact of movable element 332 by using the magnetic flux generated by excitation coil 41, and spring 42 moves movable element 332, thereby turning contactor 2 into the open state. In the following description, the operation in which trip device 4 turns contactor 2 into the open state is referred to as "trip."

In accordance with the embodiment, trip device 4 further includes yoke 44 corresponding to yoke 34 of electromagnet device 3, in addition to excitation coil 41 and spring 42.

Yoke 44 together with movable element block 33 forms a magnetic path through which a magnetic flux generated by energized excitation coil 41 passes. Yoke 44 is made of magnetic material.

In accordance with the embodiment, lower yoke plate 342 of yoke 34 and bush 344 also serve as an upper plate of yoke 44. Yoke 44 includes lower plate 442 that is provided under excitation coil 41 and faces lower yoke plate 342 of yoke 34. In the following description, lower yoke plate 342 and bush 344 serving as the upper plate of yoke 44 will be described as not only a part of yoke 34 but also a member constituting a part of yoke 44.

Yoke 44 further includes side plates 443 connecting a peripheral edge of lower yoke plate 342 to a peripheral edge of lower plate 442. Each of lower yoke plate 342 and lower plate 442 has a rectangular plate shape. Each of sides of the lower surface of lower yoke plate 342 opposite to each other is connected to respective one of sides of an upper surface of lower plate 442 opposite to each other via respective one of side plates 443. Side plates 443 and lower plate 442 are made unitarily of a single plate.

Yoke 44 further includes ferromagnetic core 444 fixed to lower plate 442. Ferromagnetic core 444 is a fixed ferromagnetic core having a circular columnar shape projecting from a center portion of the upper surface of lower plate 442 toward upward direction D1A. A lower end of ferromagnetic core 444 is fitted into holding aperture 442C formed in the center portion of the lower plate 442 to be fixed to lower plate 442. An outer diameter of ferromagnetic core 444 is substantially identical to as the outer diameter of fixed element 32.

Excitation coil 41 is disposed in a space surrounded by yoke 44 including lower yoke plate 342, bush 344, lower plate 442, side plates 443, and ferromagnetic core 444. The lower end of tubular body 36 is disposed inside excitation coil 41. In other words, tubular body 36 passes through lower yoke plate 342 of yoke 34 while the lower end of tubular body 36 extends to the inside of excitation coil 41. Movable element block 33, excitation coil 41, and ferromagnetic core 444 have center axis L31 on a straight line along upward and downward directions D1 (a longitudinal direction).

Figure 5A:
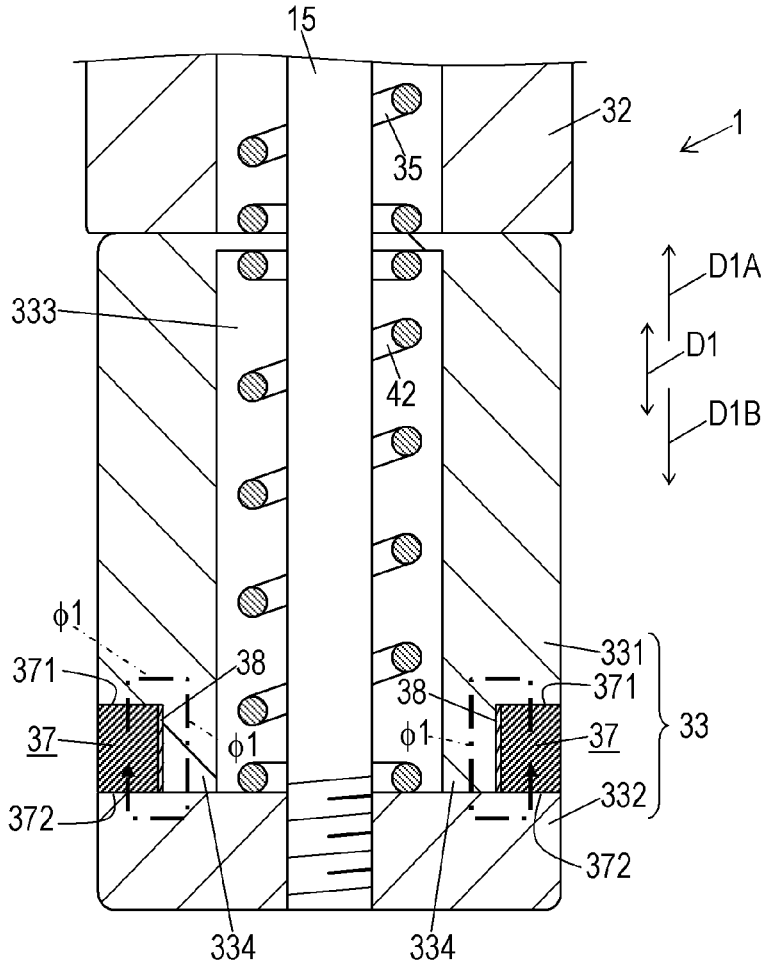
FIG. 5A is a schematic cross-sectional view of a main part of the electromagnetic relay in accordance with Embodiment 1 at a normal time.
Figure 5B:
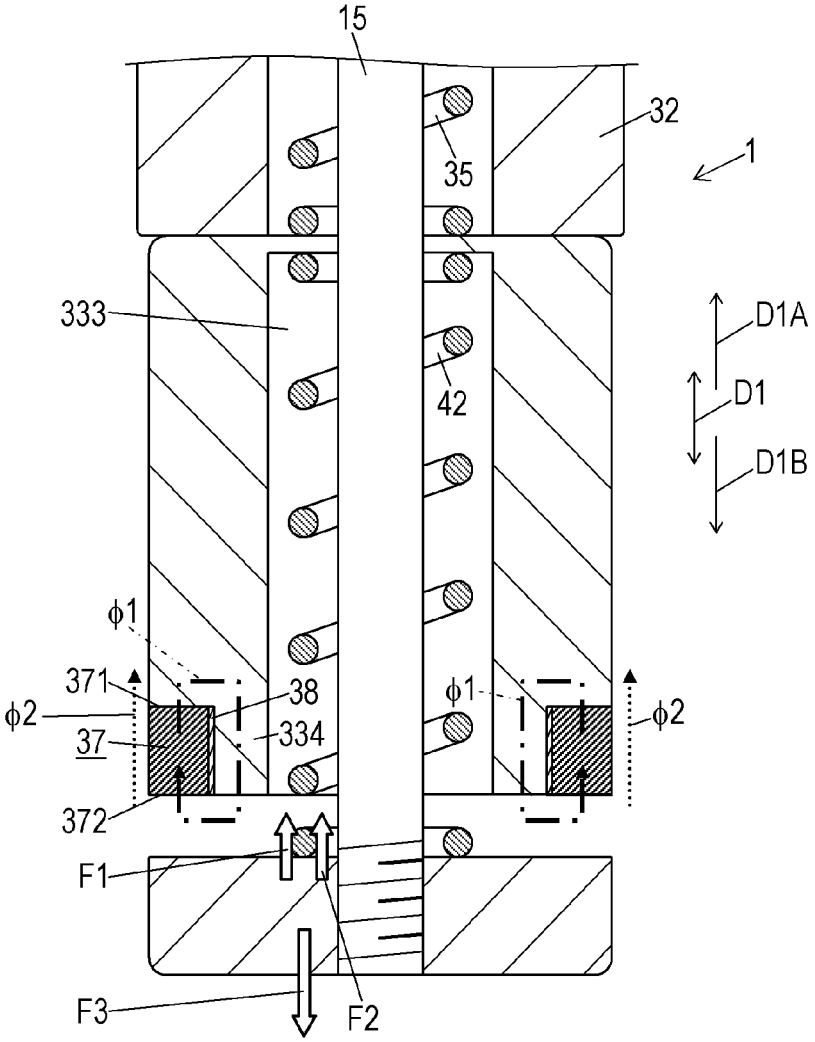
FIG. 5B is a schematic cross-sectional view of a principal part of the electromagnetic relay in accordance with Embodiment 1 while the trip device is activated.

An operation of trip device 4 will be described below. FIGS. 5A and 5B are schematic cross-sectional views of electromagnetic relay 1. FIGS. 5A and 5B illustrate movable element block 33 in tubular body 36, but have the illustration of tubular body 36 and components located outside tubular body 36 omitted. FIG. 5A shows electromagnetic relay 1 in the normal time when trip device 4 is not activated while FIG. 5B shows electromagnetic relay 1 in the state where trip device 4 is activated.

In the normal time when an abnormal current does not flow into contactor 2, i.e., in the state where trip device 4 is not activated, magnetic flux $\phi 1$ of permanent magnet 37 unifies movable elements 331 and 332 into a single substance, as shown in FIG. 5A. In other words, in this state, magnetic flux $\phi 1$ generated by permanent magnet 37 forms a loop in which magnetic flux $\phi 1$ comes out from magnetic pole surface 371, passes through movable element 331, magnetic-path portion 334, and movable element 332 in this order, and returns back to magnetic pole surface 372. The magnetic flux in the loop causes movable element 331 to attractingly contact movable element 332, thus unifying movable elements 331 and 332 to constitute movable element block 33.

On the other hand, when the abnormal current flows into contactor 2 and trip device 4 is activated, magnetic flux $\phi 2$ generated by excitation coil 41 releases the attracting contact of movable element 332 caused by permanent magnet 37, as shown in FIG. 5B. In other words, magnetic flux $\phi 2$ decreases magnetic flux $\phi 1$ generated by permanent magnet 37, and reduces a magnetic attraction force between movable elements 331 and 332 caused by permanent magnet 37. In accordance with the embodiment, as shown in FIG. 5B, the magnetic polarity (i.e., a direction of the magnetic pole surface) of permanent magnet 37 is determined such that magnetic flux $\phi 2$ generated by excitation coil 41 and magnetic flux $\phi 1$ generated in permanent magnet 37 have the same direction in permanent magnet 37. Therefore, in magnetic-path portion 334, the direction of magnetic flux $\phi 2$ generated by excitation coil 41 becomes opposite to the direction of magnetic flux $\phi 1$ generated in permanent magnet 37, so that magnetic flux $\phi 1$ is decreased or eliminated because magnetic flux $\phi 2$ cancels magnetic flux $\phi 1$.

In this state, forces F1 to F3 shown in FIG. 5B act on movable element 332. In other words, force F1 serving as the magnetic attraction force between movable element 332 and movable elements 331 and force F2 serving as the spring force of contact-pressure spring 14 act on movable element 332 in upward direction D1A, and force F3 serving as the spring force of spring 42 acts on movable element 332 in downward direction D1B.

Force F1 is an attraction force caused by magnetic flux $\phi 1$ of permanent magnet 37 and acts on movable element 332 from movable element 331. Force F2 is a force caused by contact-pressure spring 14 and presses up shaft 15 in upward direction D1A via movable contact base 13, i.e., a spring force from contact-pressure spring 14 acting on movable element 332 via movable contact base 13 and shaft 15. However, if contactor 2 is in the closed state, shaft 15 is further pressed up after movable contact 21 contacts fixed contact 22, so that shaft 15 may thus have an appropriate overrun range. For that reason, in the closed state of contactor 2 in which the overrun is caused, force F2 from contact-pressure spring 14 acting on movable element 332 is zero. Force F3 is a spring force caused by spring 42 and acts on movable element 332 in downward direction D1B away from movable element 331.

In electromagnetic relay 1, when the relationship between forces F1 to F3 satisfies the condition of $F1+F2<F3$, the attracting contact of movable element 332 is released and movable element 332 is moved in downward direction D1B away from the movable element 331, thereby turning contactor 2 into the open state (tripped). If contactor 2 is in the closed state, force F2 is zero. Therefore, the condition for releasing the attracting contact of movable element 332 is changed to $F1<F3$, as mentioned above. In short, if force F1 acting in upward direction D1A is larger than or equal to force F3 acting in downward direction D1B, movable element 332 is unified with movable element 331. When force F3 exceeds force F1, the attracting contact is released and movable element 332 is removed away from movable element 331.

The attraction force (force F1) between movable element 332 and movable elements 331 caused by permanent magnet 37 does not act on movable element 332 removed away from movable element 331. For that reason, while movable element 332 is removed away from movable element 331, movable element 332 stays at the position where force F3 from spring 42 acting on movable element 332 and force F2 from contact-pressure spring 14 acting on movable element 332 are balanced. In accordance with the embodiment, a position (hereinafter, referred to as "trip position") of movable element 332 allowing movable element 332 to be removed away from movable element 331 is identical to the position (normal position) of movable element 332 in the normal time when movable element 332 is in the OFF state. However, the trip position of movable element 332 may not necessarily be identical to the normal position, but may be provided between the attracted position and the lower limit position.

Trip device 4 does not necessarily trip, i.e., is not necessarily even when the current flows into excitation coil 41. Trip device 4 is not activated until force F1, which is the attraction force acting on movable element 332 caused by permanent magnet 37, satisfies the above-mentioned condition (F1<F3). Force F3 is determined by spring design. The attraction force which is caused by permanent magnet 37 and acts on movable element 332 changes (decreases) depending on magnetic flux $\phi 2$ generated by excitation coil 41. Magnetic flux $\phi 2$ changes depending on the amount of a current (a load current flowing through load 102) flowing through excitation coil 41. Trip device 4 is activated such that force F1, which is the attraction force caused by permanent magnet 37 and acting on movable element 332, satisfies the above-mentioned condition (F1<F3) when the current, which flows through excitation coil 41, increases to the abnormal current equal to or larger than the predetermined value.

In other words, trip device 4 is activated to release the attracting contact of movable element 332 and move movable element 332 when the abnormal current equal to or larger than the predetermined value, such as overcurrent or a short-circuit current, flows through contactor 2. Trip device 4 also maintains the state where movable element 331 attractingly contacts movable element 331 when the normal current smaller than the predetermined value flows through contactor 2. Specifically, for trip device 4, the number of turns of excitation coil 41 is determined such that force F1 satisfies the above-mentioned condition when the current more than or equal to the predetermined value flows through excitation coil 41. The above-mentioned predetermined value which causes trip device 4 to start activating is determined to be, e.g. an overcurrent value sufficiently larger than the rated current of electromagnetic relay 1 or a short-circuit current value. For instance, the overcurrent value may be about five to ten times the amount of the rated current. The short-circuit current value may be about several ten times the amount of the rated current.

When the abnormal current, such as a overcurrent or a short-circuit current, flows through contactor 2, electromagnetic relay 1 releases the attracting contact of movable element 332, and forcibly turns contactor 2 into the open state by using spring 42. As a result, electromagnetic relay 1 releases the attracting contact of movable element 332 and forcibly causes movable element 332 to move by using the magnetic flux generated when the abnormal current flows, thus quickly detecting occurrence of the abnormal current and cutting an electric path (contactor 2) rapidly.

In the case where a significantly large abnormal current, such as a short-circuit current, flows into contactor 2, if trip device 4 is activated, magnetic flux $\phi 2$ generated by excitation coil 41 increases. Large magnetic flux $\phi 2$ generates an attraction force between movable element block 33 and ferromagnetic core 444. In other words, trip device 4 causes magnetic flux $\phi 2$ generated by excitation coil 41 to generate a magnetic attraction force for moving movable element 332 downward together with movable element 331. In this case, movable element 332 moves to the lower limit position passing through the normal position. Then, the attracting contact of movable element 332 is released while movable element 332 moves together with movable element 331, so that movable element 332 moves faster with respect to fixed element 32 than the case where movable element 331 is stopped. As a result, contactor 2 is opened quickly when trip device 4 trips. Therefore, electromagnetic relay 1 can cut the electric path (contactor 2) rapidly by using magnetic flux $\phi 2$ generated when the abnormal current flows.

As mentioned above, since magnetic flux $\phi 2$ generated by excitation coil 41 and magnetic flux $\phi 1$ generated by permanent magnet 37 are determined to have the same direction in permanent magnet 37, magnetic flux $\phi 2$ generated by excitation coil 41 acts to increase magnetic flux $\phi 1$ with respect to permanent magnet 37. For that reason, even if very large magnetic flux $\phi 2$ occurs in excitation coil 41 when trip device 4 is tripped, magnetic flux $\phi 2$ is prevented from demagnetizing (or degaussing) permanent magnet 37.

As mentioned above, excitation coil 41 is connected in series to contactor 2 between output terminals 51 and 52. Therefore, excitation coil 41 partially constitutes a path of a load current supplied from drive battery 101 to load 102 when contactor 2 is in the closed state. Excitation coil 41 is activated by the load current. For that reason, bypass path 6 (see FIG. 2) may be electrically connected in parallel to excitation coil 41 to allow the load current to flow through a path other than excitation coil 41. If bypass path 6 is provided, a part of the load current which is supplied from drive battery 101 to load 102 flows through bypass path 6 of electromagnetic relay 1, thereby reducing a loss in excitation coil 41.

Trip device 4 may be configured such that magnetic flux $\phi 2$ generated by excitation coil 41 releases the attracting contact of movable element 332 caused by permanent magnet 37. Thus, yoke 44 is not an essential component for trip device 4. Therefore, yoke 44 may be omitted.

(1.5) Operation when Abnormal Current Occurs

Figure 6:
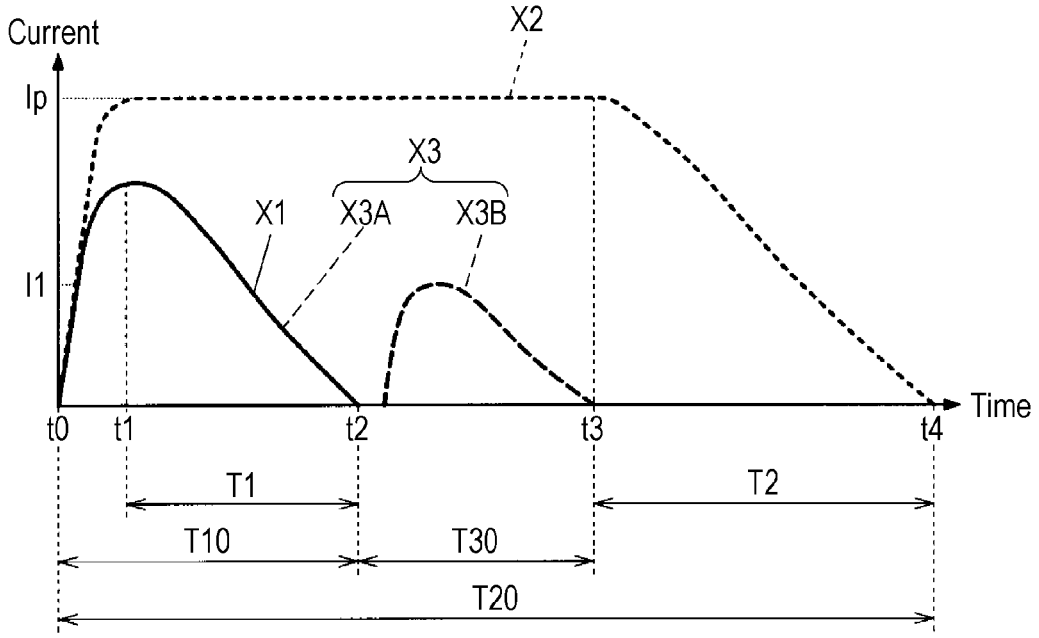
FIG. 6 illustrates an operation of the electromagnetic relay in accordance with Embodiment 1.

This section will briefly describe an operation of electromagnetic relay 1 including trip device 4 in response to the abnormal current in the closed state of contactor 2 and cut an electric path quickly. FIG. 6 illustrates the operation of electromagnetic relay 1. In FIG. 6, a horizontal axis represents time, and a vertical axis represents a load current flowing through an electric path between battery 101 and load 102, i.e., contactor 2. In the operation shown in FIG. 6, a short circuit occurs in load 102 at time point t0. FIG. 6 shows load current X1 of electromagnetic relay 1 including trip device 4 in accordance with the embodiment, and load current X2 of an electromagnetic relay of a first comparative example which does not include trip device 4.

An operation of the electromagnetic relay of the first comparative example which does not including trip device 4 will be described. The electromagnetic relay of the first comparative example has the same structure as electromagnetic relay 1 in accordance with the embodiment except that the electromagnetic relay does not include trip device 4 and shaft 15 is joined to movable element block 33. Even if a short circuit occurs at time point t0 and load current X2 increases to short-circuit current Ip, the electromagnetic relay of the first comparative example can hardly turns contactor 2 into the open state immediately. In this case, ECU 103 detects the occurrence of the abnormal current according to its protective function, and turns off switching element 104 via a control signal. Thus, load current X2 begins decreasing from time point t3 when energization of excitation coil 31 is stopped. Interrupting duration T2 is more necessary to extinguish an arc between fixed contact 22 and movable contact 21 and an arc between fixed contact 122 and movable contact 121, and interrupt load current X2. As a result, load current X2 is interrupted at time point t4 when duration T20 elapses from since time point t0.

FIG. 6 further shows load current X3 of an electromagnetic relay of a second comparative example including trip device 4. In the electromagnetic relay of the second comparative example, movable element 331 and movable element 332 are tightly coupled so as not to disassemble movable element block 33. Load current X3 is the total of load current X3A and load current X3B. In the electromagnetic relay of the second comparative example, when trip device 4 is activated, an attraction force is caused between movable element block 33 and ferromagnetic core 444 by magnetic flux ϕ2 generated by excitation coil 41, and moves movable element block 33 in downward direction D1B, thereby turning contactor 2 into the open state. When a short-circuit occurs at time point t0 and load current X3A increases to predetermined value I1, the electromagnetic relay of the second comparative example turns contactor 2 into the open state by itself using trip device 4. For that reason, load current X3A starts decreasing from time point t1 immediately after reaching predetermined value I1. Load current X3A is stopped at time point t2 when duration T10 (<T20) elapses from time point t0, although interrupting duration T1 is more necessary to extinguish the arc between fixed contact 22 and movable contact 21 and the arc between fixed contact 122 and movable contact 121, and stop load current X3A.

The electromagnetic relay of the second comparative example operates (trip) trip device 4 by using the load current. Therefore, when the load current is stopped, energization of excitation coil 41 is stopped. Thus, chattering is likely to occur until time point t3 when the energization of excitation coil 31 is stopped since contactor 2 may possibly be turned into the closed state again after the load current is interrupted. Load current X3B is caused by the chattering. In other words, in the electromagnetic relay of the second comparative example, when the abnormal current occurs, contactor 2 may be possibly turned into the closed state again after contactor 2 is turned into the open state, and after that, chattering which repeats opening and closing contactor 2 likely occurs.

An operation of electromagnetic relay 1 in accordance with the embodiment will be described below. In electromagnetic relay 1 in accordance with the embodiment, electromagnetic relay 1 includes trip device 4 to turn contactor 2 into the open state by itself, similarly to the electromagnetic relay of the second comparative example. Accordingly, load current X1 starts decreasing from time point t1 immediately after reaching the predetermined value. For electromagnetic relay 1 in accordance with the embodiment, when trip device 4 is activated, magnetic flux ϕ2 generated by excitation coil 41 releases the attracting contact of movable element 332 caused by permanent magnet 37. For that reason, after trip device 4 is activated, a force from spring 42 acts on movable element 332, thereby maintaining the state where movable element 332 is removed away from movable element 331. Therefore, at time point t2 when interrupting duration T1 elapses from time point t1, even if load current X1 is interrupted and the energization of excitation coil 41 is stopped, contactor 2 maintains the open state.

As a result, electromagnetic relay 1 in accordance with the embodiment prevents the chattering in which contactor 2 is turned into the closed state again after trip device 4 trips and stops the load current. Consequently, Electromagnetic relay 1 according to the embodiment provides a shorter duration required to stop the load current by duration T30 (from time point t2 to time point t3) than the electromagnetic relay of the second comparative example.

Electromagnetic relay 1 in accordance with the embodiment which includes trip device 4 advantageously prevents a rise of the load current. In other words, in the electromagnetic relay of the first comparative example which does not include trip device 4, contactor 2 is not opened immediately even when load current X2 reaches an overload current. This may cause such a disadvantage that load current X2 continuously increases and may reach short-circuit current Ip larger than the overcurrent. On the other hand, electromagnetic relay 1 including trip device 4 in accordance with the embodiment can stop load current X1 before load current X1 increases to a short-circuit current since contactor 2 is opened immediately after load current X1 reaches the overcurrent. For example, the overcurrent described herein has a current value about five to ten times the amount of the rated current of the relay, and the short-circuit current has a current value about several ten times the amount of the rated current.

Load current X1 shown in FIG. 6 indicates a conceptual profile, but specifically, the profile of electromagnetic relay 1 in accordance with the embodiment is not limited to the profile shown in FIG. 6 since an overshoot may occur in load current X1 by the time when trip device 4 is activated.

(1.6) Effects

In electromagnetic relay 1 in accordance with the embodiment described above, when the abnormal current flows into contactor 2, trip device 4 is activated. The magnetic flux generated by excitation coil 41 releases the attracting contact of movable element 332 caused by permanent magnet 37. Accordingly, movable element 332 is moved in a direction away from the movable element 331 by spring 42 so as to turn contactor 2 into the open state. In other words, when the abnormal current flows, trip device 4 removes movable element 332 away from movable element 331. Upon moving, movable element 332 forcibly turns contactor 2 into the open state. After trip device 4 is activated, the force from spring 42 acts on movable element 332 to maintaining the state where movable element 332 is removed away from movable element 331.

In electromagnetic relay 1 in accordance with the embodiment, after trip device 4 is activated to forcibly turn contactor 2 into the open state, the state where movable element 332 is removed away from movable element 331 is thus maintained even if the driving force of excitation coil 41 is removed. As a result, even if movable element 331 is attracted toward fixed element 32 due to the magnetic flux generated by excitation coil 31, movable element 332 does not return back to the attracted position, thus maintaining contactor 2 in the open state. Consequently, electromagnetic relay 1 advantageously, maintains contactor 2 in the open state when the abnormal current flows into contactor 2.

In electromagnetic relay 1 in accordance with the embodiment, permanent magnet 37 is preferably provided at movable element 331. This structure allows permanent magnet 37 and movable element 331 to be treated as a single component. Thus, the number of components of electromagnetic relay 1 can be reduced as compared with the case where permanent magnet 37 is separated from movable element 331. Furthermore, as compared with the case where permanent magnet 37 is provided at movable element 332, a miniaturization and weight saving of movable element 332 can be achieved, thereby improving in a moving speed of movable element 332 when trip device 4 is activated.

In electromagnetic relay 1 in accordance with the embodiment, electromagnet device 3 may preferably further include magnetic-path portion 334. Magnetic-path portion 334 together with movable elements 331 and 332 forms a closed magnetic path through which the magnetic flux generated by permanent magnet 37 passes while permanent magnet 37 causes movable element 332 attractingly contacts movable element 331. This configuration increases the attraction force caused by permanent magnet 37 and acting between movable elements 331 and 332, as compared with the case where the magnetic flux generated by permanent magnet 37 passes through an open magnetic circuit, thereby increasing the attraction force of movable element 332 in the normal time. However, magnetic-path portion 334 is not an essential configuration for electromagnetic relay 1, and may be omitted.

In electromagnetic relay 1 in accordance with the embodiment, magnetic-path portion 334 is preferably provided at movable element 331. This configuration allows movable element 331 and magnetic-path portion 334 to be treated as a single component. Thus, the number of components of electromagnetic relay 1 can be reduced as compared with the case where magnetic-path portion 334 is separated from movable element 331.

In electromagnetic relay 1 in accordance with the embodiment, short-circuit prevention portion 38 made of nonmagnetic material is preferably provided between permanent magnet 37 and magnetic-path portion 334. This configuration prevents the magnetic flux generated by permanent magnet 37 from short-circuiting through a surface of magnetic-path portion 334 contacting permanent magnet 37. However, short-circuit prevention portion 38 is not essential configuration for electromagnetic relay 1, and may be omitted.

(1.7) Modifications (1.7.1) Modification 1

Figure 7A:
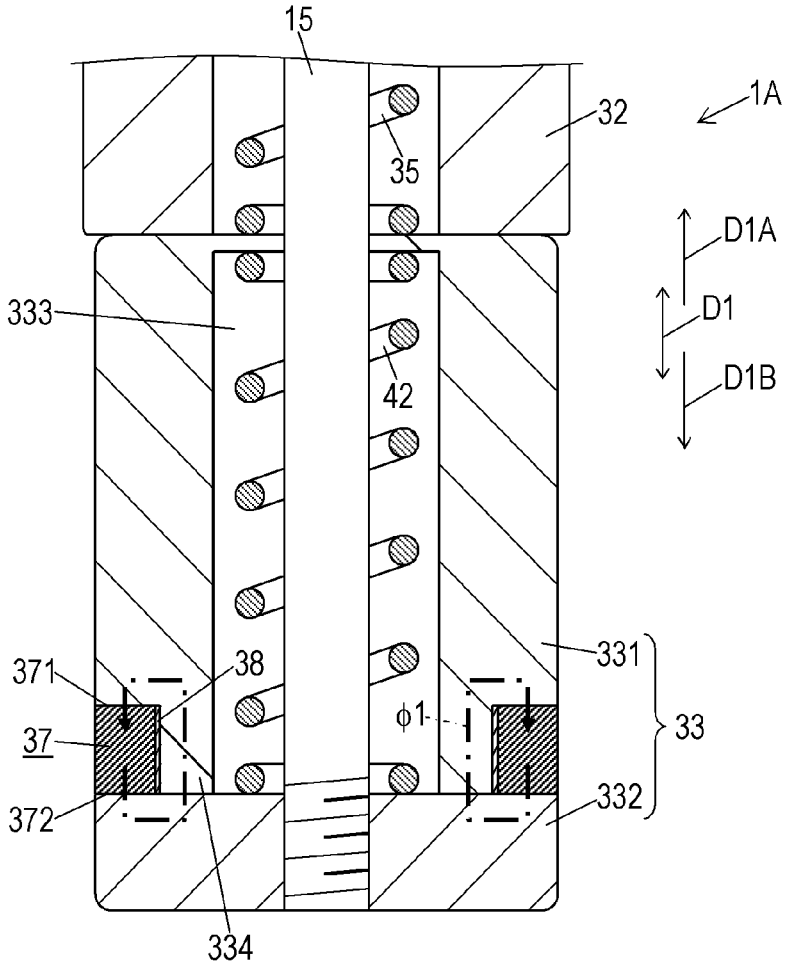
FIG. 7A is a schematic cross-sectional view of a main part of another electromagnetic relay in accordance with Embodiment 1 in a normal time.
Figure 7B:
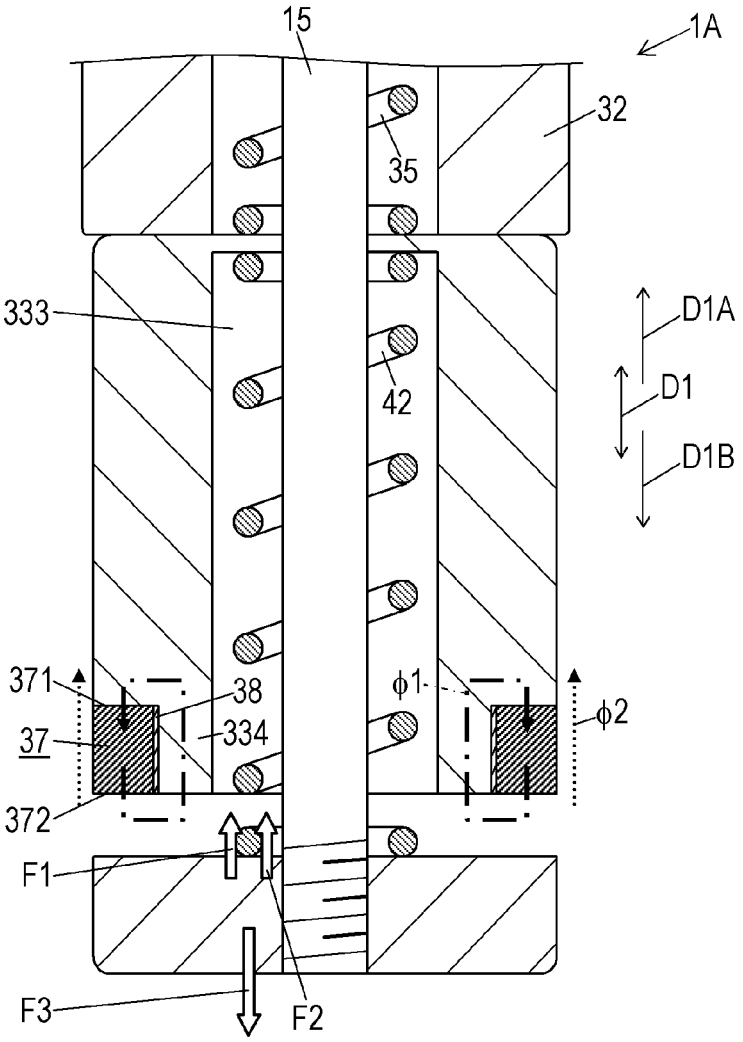
FIG. 7B is a schematic cross-sectional view of the main part of the electromagnetic relay shown in FIG. 7A while the trip device is activated.

FIGS. 7A and 7B are cross-sectional views of another electromagnetic relay 1A in accordance with Embodiment 1. In FIGS. 7A and 7B, components identical to those of electromagnetic relay 1 shown in FIGS. 1 to 6 are denoted by the same reference numerals. FIGS. 7A and 7B illustrate movable element block 33 in tubular body 36, but the illustration of tubular body 36 and components located outside tubular body 36 is omitted.

In electromagnetic relay 1A, magnetic polarity of permanent magnet 37, i.e., directions of the magnetic pole surfaces thereof are determined such that magnetic flux $\phi$2 generated by excitation coil 41 is opposite to magnetic flux $\phi$1 generated in permanent magnet 37 in permanent magnet 37. In other words, in electromagnetic relay 1A, a magnetizing direction of electromagnetic relay 1 is opposite to that of permanent magnet 37. Magnetic pole surface 371 is an S pole while magnetic pole surface 372 is an N pole.

In electromagnetic relay 1A, magnetic flux $\phi$1 of permanent magnet 37 unifies movable elements 331 and 332 into a single substance, as shown in FIG. 7A, in the normal time when the abnormal current does not flow into contactor 2, i.e., in the state where trip device 4 is not activated. In other words, in this state, magnetic flux $\phi$1 generated by permanent magnet 37 forms a loop in which magnetic flux $\phi$1 comes out from magnetic pole surface 372, passes through movable element 332, magnetic-path portion 334, and movable element 332 in this order, and returns back to magnetic pole surface 371.

On the other hand, when the abnormal current flows into contactor 2 and trip device 4 is activated, magnetic flux $\phi$2 generated by excitation coil 41 releases the attracting contact of movable element 332 caused by permanent magnet 37, as shown in FIG. 7B. In other words, magnetic flux $\phi$2 generated by excitation coil 41 decreases magnetic flux $\phi$1 generated by permanent magnet 37, and reduces a magnetic attraction force between movable elements 331 and 332 caused by permanent magnet 37. In electromagnetic relay 1A, magnetic flux $\phi$2 generated by excitation coil 41 is opposite to magnetic flux $\phi$1 generated by permanent magnet 37 in permanent magnet 37, as shown in FIG. 7B. Therefore, magnetic flux $\phi$1 is decreased or eliminated since magnetic flux $\phi$2 cancels magnetic flux $\phi$1. Thus, the attracting contact is released, so that movable element 332 is removed away from movable element 331.

(1.7.2) Modification 2

Figure 8A:
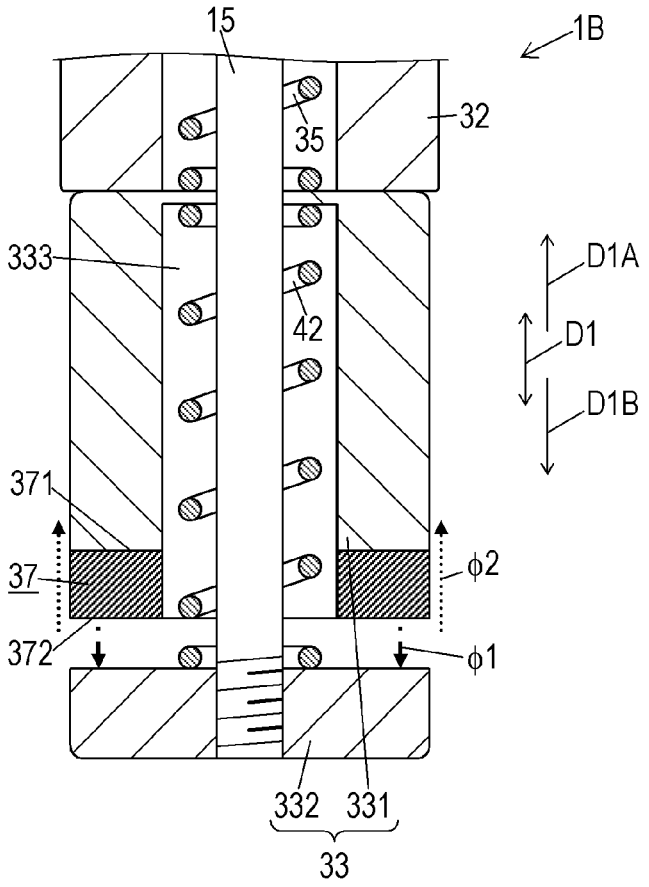
FIG. 8A is a schematic cross-sectional view of a main part of still another electromagnetic relay in accordance with Embodiment 1.
Figure 8B:
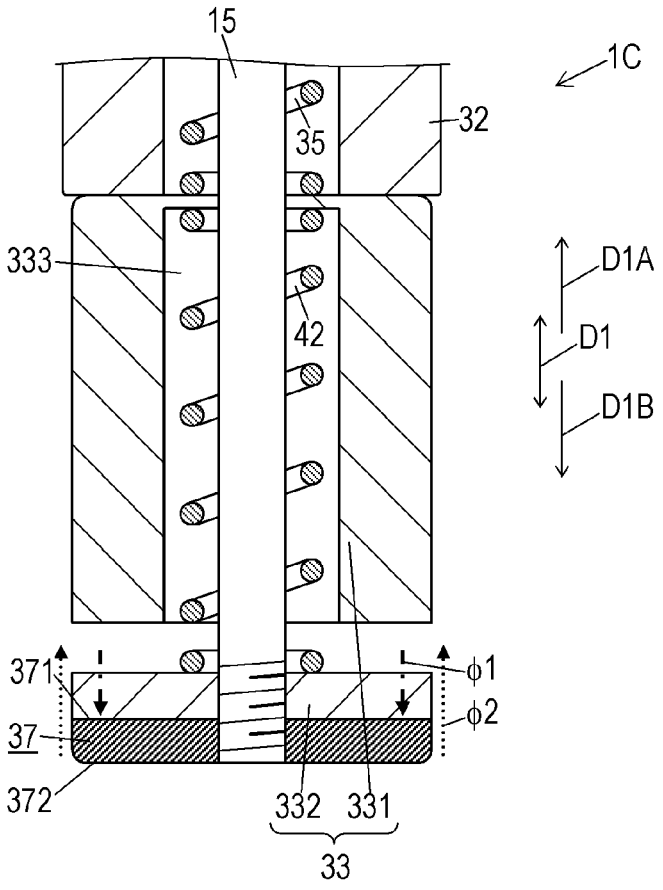
FIG. 8B is a schematic cross-sectional view of a main part of the electromagnetic relay shown in FIG. 8A.
Figure 8C:
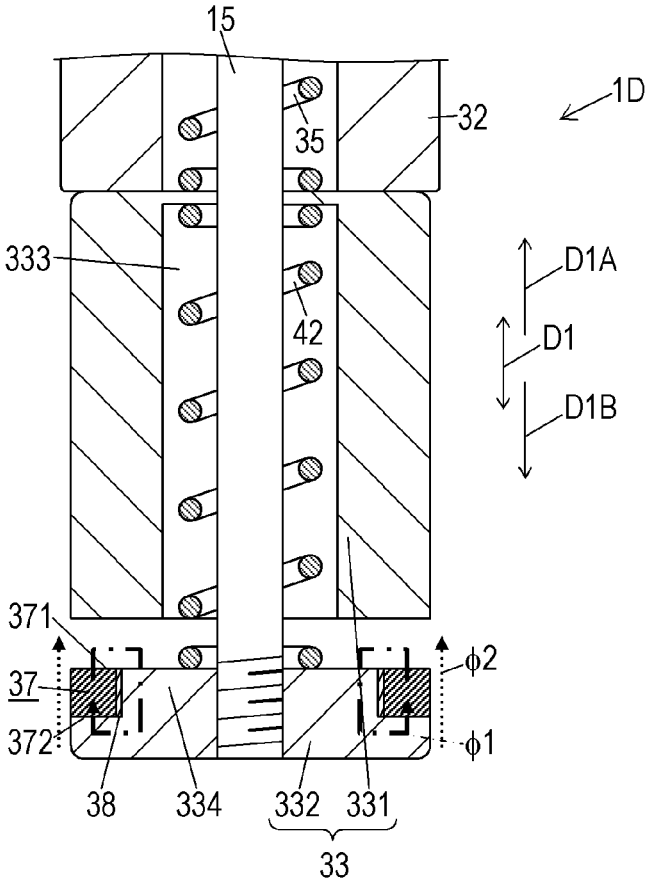
FIG. 8C is a schematic cross-sectional view of the principal part of the electromagnetic relay shown in FIG. 8A.

FIGS. 8A to 8C are cross-sectional views of still another electromagnetic relays 1B, 1C, and 1D in accordance with Embodiment 1, respectively. In FIGS. 8A to 8C, components identical to those of electromagnetic relay 1 shown in FIGS. 1 to 6 and electromagnetic relay 1A shown in FIGS. 7A and 7B are denoted by the same reference numerals. Electromagnetic relay 1B is different from electromagnetic relays 1 and 1A in the shape and arrangement of permanent magnet 37. In other words, the shape and arrangement of permanent magnet 37 are not limited to those of electromagnetic relay 1 shown in FIGS. 5A and 5B, but may be changed as necessary like electromagnetic relays 1B, 1C, and 1D shown in FIGS. 8A to 8C. FIGS. 8A to 8C illustrate movable element block 33 within tubular body 36, but the illustration of tubular body 36 and components located outside tubular body 36 is omitted.

Electromagnetic relay 1B shown in FIG. 8A does not include magnetic-path portion 334. Permanent magnet 37 is attached to movable element 331 to entirely cover the lower end surface of movable element 331. Permanent magnet 37 has magnetic pole surfaces 371 and 372 located on both ends thereof in a longitudinal direction (upward and downward directions D1) and having polarities different from each other. Even in electromagnetic relay 1B with such a structure, magnetic flux $\phi$1 generated by permanent magnet 37 causes movable element 332 to attractingly contact movable element 331 in the normal time when an abnormal current does not flow into contactor 2, i.e., in the state where trip device 4 is not activated. On the other hand, when the abnormal current flows into contactor 2 and trip device 4 is activated, excitation coil 41 generates magnetic flux $\phi$2 in permanent magnet 37 similarly to electromagnetic relay 1A shown in FIGS. 7A and 7B. The direction of magnetic flux $\phi$2 is opposite to the direction of magnetic flux $\phi$1 of permanent magnet 37. This configuration releases the attracting contact of movable element 332, so that movable element 332 is removed away from movable element 331.

In electromagnetic relay 1C shown in FIG. 8B, permanent magnet 37 is provided at movable element 332. Electromagnetic relay 1C does not include magnetic-path portion 334, and permanent magnet 37 is attached to movable element 332 to entirely cover the lower end surface of movable element 332. Permanent magnet 37 has magnetic pole surfaces 371 and 372 provided on both ends thereof in a longitudinal direction and having polarities different from each other. Even in electromagnetic relay 1C with such a structure, magnetic flux ϕ1 generated by permanent magnet 37 causes movable element 332 to attractingly contact movable element 331 in the normal time when the abnormal current does not flow into contactor 2, i.e., in the state where trip device 4 is not activated. On the other hand, when the abnormal current flows into contactor 2 and trip device 4 is activated, excitation coil 41 generates magnetic flux ϕ2 in permanent magnet 37 similarly to electromagnetic relay 1A shown in FIGS. 7A and 7B. the direction of magnetic flux ϕ2 is opposite to the direction of magnetic flux ϕ1 of permanent magnet 37. This releases the attracting contact of movable element 332, so that movable element 332 is removed away from movable element 331.

In electromagnetic relay 1D shown in FIG. 8C, permanent magnet 37 is provided at movable element 332, and magnetic-path portion 334 is further provided at movable element 332. Permanent magnet 37 is attached to the upper end surface of movable element 332. Magnetic-path portion 334 has an annular shape, and projects in upward direction D1A from the upper end surface of movable element 332 which serves as an outer circumference edge of shaft 15. Permanent magnet 37 which has an annular shape concentric with magnetic-path portion 334 is disposed outside magnetic-path portion 334 to surround magnetic-path portion 334. In other words, magnetic-path portion 334 is inserted into a hollow in permanent magnet 37, and thus permanent magnet 37 is attached to movable element 332.

In electromagnetic relay 1D shown in FIG. 8C, permanent magnet 37 has magnetic pole surfaces 371 and 372 located on both ends thereof in the longitudinal direction (upward and downward directions D1) and having different polarities from each other. Even in electromagnetic relay 1D with such a structure, magnetic flux ϕ1 generated in permanent magnet 37 causes movable element 332 to attractingly contact movable element 331 in the normal time when the abnormal current does not flow into contactor 2, i.e., in the state where trip device 4 is not activated. On the other hand, when the abnormal current flows into contactor 2 and trip device 4 is activated, excitation coil 41 generates magnetic flux ϕ2 in magnetic-path portion 334 similarly to the electromagnetic relay 1 shown in FIGS. 5A and 5B. The direction of magnetic flux ϕ2 is opposite to the direction of magnetic flux ϕ1 of permanent magnet 37. This releases the attracting contact of movable element 332, so that movable element 332 is removed away from movable element 331. In electromagnetic relay 1D shown in FIG. 8C, short-circuit prevention portion 38 made of nonmagnetic material is provided between permanent magnet 37 and magnetic-path portion 334.

In the case that permanent magnet 37 is provided at movable element 332, permanent magnet 37 and movable element 332 can be treated as a single component like electromagnetic relays 1C and 1D shown in FIGS. 8B and 8C. For that reason, the number of components of electromagnetic relay 1 can be reduced as compared with the case where permanent magnets 37 is separated from movable element 332.

In the case that magnetic-path portion 334 is provided at movable element 332, movable element 332 and magnetic-path portion 334 can be treated as a single component like electromagnetic relay 1D shown in FIG. 8C. For that reason, the number of components of electromagnetic relay 1D can be reduced as compared with the case where magnetic-path portion 334 is separated from movable element 332.

The shape and arrangement of permanent magnet 37 are not limited to those shown in FIGS. 8A to 8C. For instance, in accordance with Embodiment 1, permanent magnet 37 is disposed outside magnetic-path portion 334, but not limited to this. Permanent magnet 37 may be disposed inside magnetic-path portion 334. Further, each of permanent magnet 37 and magnetic-path portion 334 may be provided at respective one of movable element 331 and movable element 332 separately. For instance, permanent magnet 37 may be provided at movable element 331 while magnetic-path portion 334 may be provided at movable element 332. Permanent magnet 37 may not necessarily have the annular shape. Permanent magnet 37 may be provided only at a portion in a circumference of movable element 331.

(1.7.3) Modification 3

Figure 9:
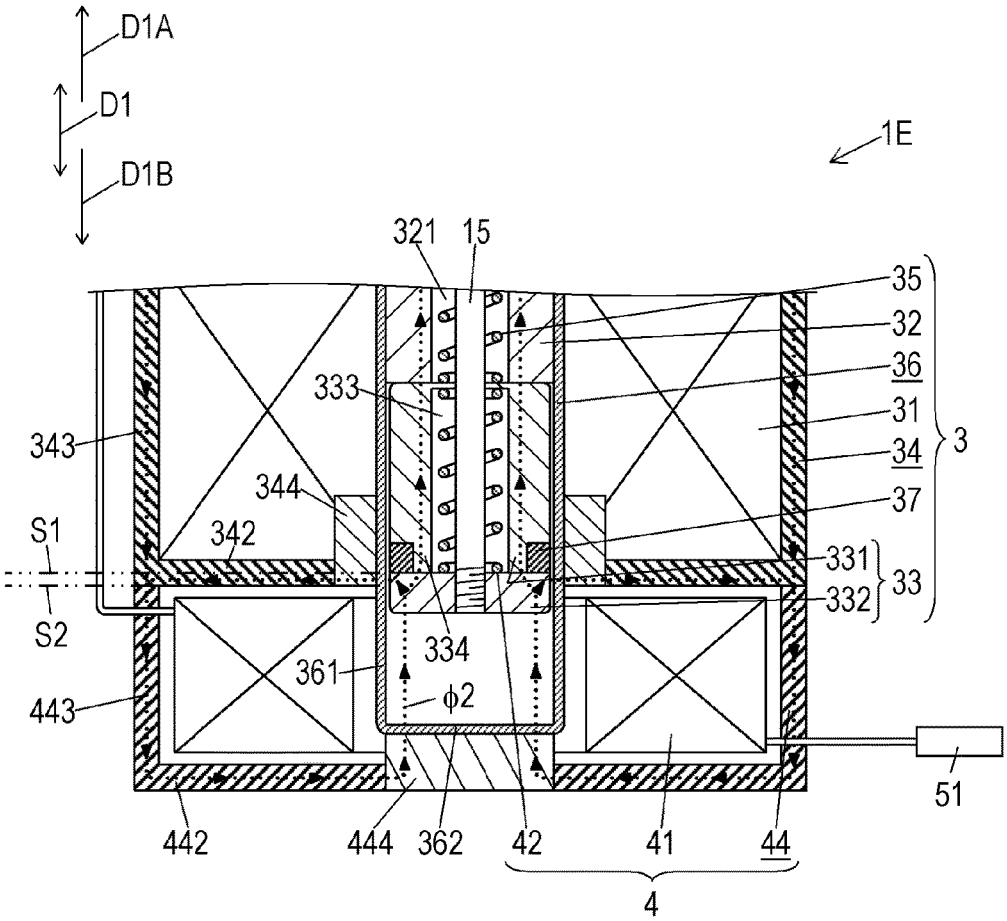
FIG. 9 is a schematic cross-sectional view of a main part of a further electromagnetic relay in accordance with Embodiment 1.

FIG. 9 is a cross-sectional view of further electromagnetic relays 1E in accordance with Embodiment 1. In FIG. 9, components identical to those of electromagnetic relay 1 shown in FIGS. 1 to 6 are denoted by the same reference numerals. In electromagnetic relay 1E, movable element 332 is disposed opposite to fixed element 32 with respect to movable element 331 in one direction (longitudinal direction, i.e., upward and downward directions D1) in which fixed element 32 and movable element 331 are arranged. Movable elements 331 and 332 move in upward and downward directions D1 due to magnetic flux ϕ1 generated by excitation coil 31. Trip device 4 includes lower yoke plate 342 serving as a yoke constituting a part of magnetic path through which the magnetic flux generated by excitation coil 41 passes along a plane perpendicularly crossing upward and downward directions D1. The above-mentioned structure is the same as that of the relay according to Embodiment 1.

In electromagnetic relay 1E, lower yoke plate 342 projects in downward direction D1B out of upward and downward directions D1 from a surface of movable element 332 facing movable element 331 when movable element 332 is located at the attracted position, that is, projects opposite to fixed element 32 from a surface of movable element 332 from the surface of movable element 332. FIG. 9 shows planes S1 and S2. Plane S1 includes the surface of movable element 332 facing movable element 331 when movable element 332 is located at the attracted position. Plane S2 includes a lower surface of lower yoke plate 342. In other words, plane S1 serves as a boundary surface between movable elements 332 and 331 when contactor 2 is in the closed state is located above plane S2 serving as the lower surface of lower yoke plate 342, that is, is located closer to fixed element 32 than plane S2 in upward and downward directions D1. In electromagnetic relay 1E shown in FIG. 9, plane S1 is located between the upper surface and the lower surface of lower yoke plate 342 in upward and downward directions D1.

While trip device 4 is activated, this configuration reduces a portion of magnetic flux ϕ2 generated by excitation coil 41 passing through the boundary surface between movable elements 332 and 331 when movable element 332 is located at the attracted position. In other words, the magnetic path through which magnetic flux ϕ2 generated by excitation coil 41 passes is divided into a magnetic path including lower yoke plate 342 and a magnetic path including movable element 331, as shown in FIG. 9. Since plane S1 is located above plane S2, the portion of the magnetic flux ϕ2 passing through movable element 331 is decreased while a portion of the magnetic flux ϕ2 passing through lower yoke plate 342 is increased. For that reason, the attraction force caused by magnetic flux ϕ2 generated by excitation coil 41 and acting between movable elements 331 and 332 is decreased, whereas the attraction force caused by magnetic flux ϕ2 generated by excitation coil 41 and acting between movable element 332 and ferromagnetic core 444 is increased. Accordingly, if trip device 4 trips at the same current value (predetermined value), the number of turns of excitation coil 41 is reduced, whereas if the number of turns of excitation coil 41 is the same, the current value when trip device 4 trips is reduced.

(1.7.4) Modification 4

Figure 10:
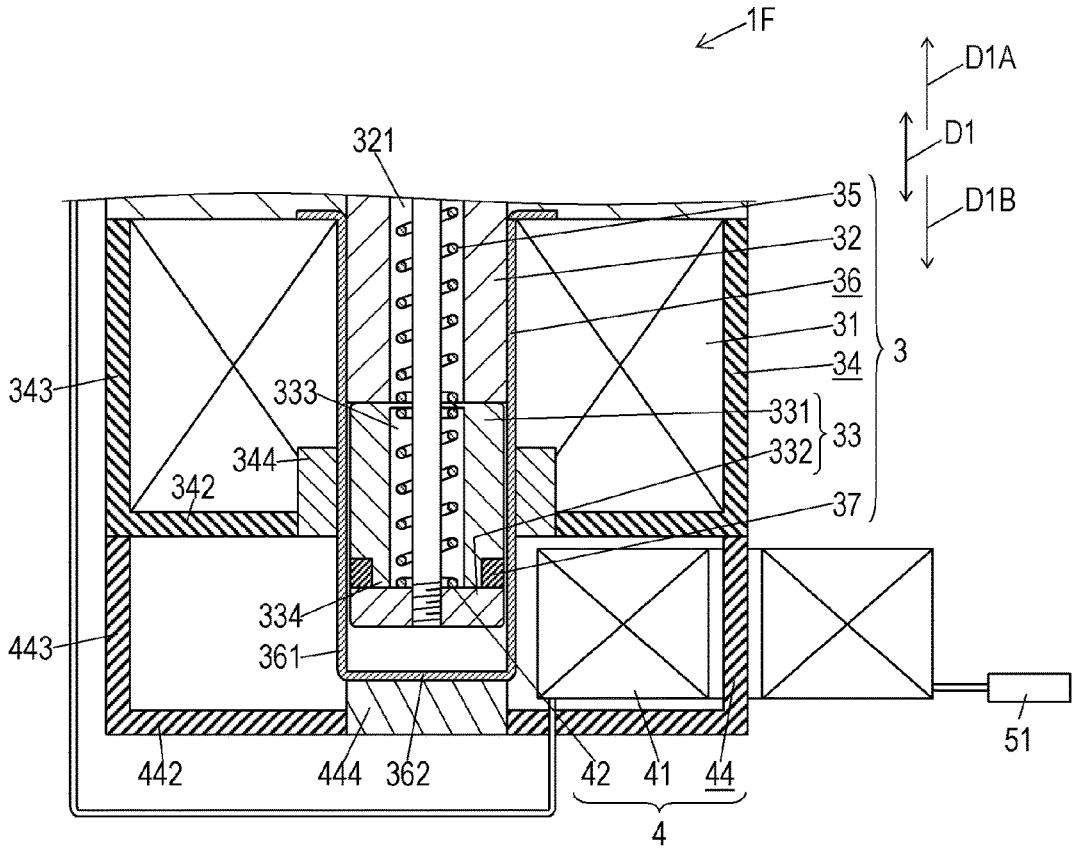
FIG. 10 is a schematic cross-sectional view of a main part of a further electromagnetic relay in accordance with Embodiment 1.

FIG. 10 is a cross-sectional view of further electromagnetic relay 1F in Embodiment 1. In FIG. 10, components identical to those of electromagnetic relay 1 shown in FIGS. 1 to 6 are denoted by the same reference numerals. In electromagnetic relay 1F, trip device 4 includes a yoke block constituting a part of a magnetic path through which the magnetic flux generated by excitation coil 41 passes. The yoke block described herein is implemented by yoke 44. This structure is the same as that of the relay according to Embodiment 1.

In electromagnetic relay 1F, excitation coil 41 is wound around a part of yoke 44 (yoke block). In electromagnetic relay 1F shown in FIG. 10, excitation coil 41 is wound around side plate 443 serving as one of side plates 443 of yoke 44. In other words, a part of yoke 44 (side plate 443) passes through a hollow in excitation coil 41, i.e., a space surrounded by the inner circumferential surface of excitation coil 41.

In this configuration, magnetic flux ϕ2 generated by excitation coil 41 tends to saturate in yoke 44 when trip device 4 is activated. In other words, magnetic flux ϕ2 generated by excitation coil 41 concentrates on a part of yoke 44 (side plate 443) around which excitation coil 41 is wound, thereby easily causing the magnetic saturation. Thus, even when a significantly large abnormal current, such as a short-circuit current, flows into contactor 2, magnetic flux ϕ2 generated by excitation coil 41 can reduce the attraction force acting between movable elements 331 and 332, thus securely activating trip device 4.

Exemplary Embodiment 2

(2.1) Summary

Figure 11A:
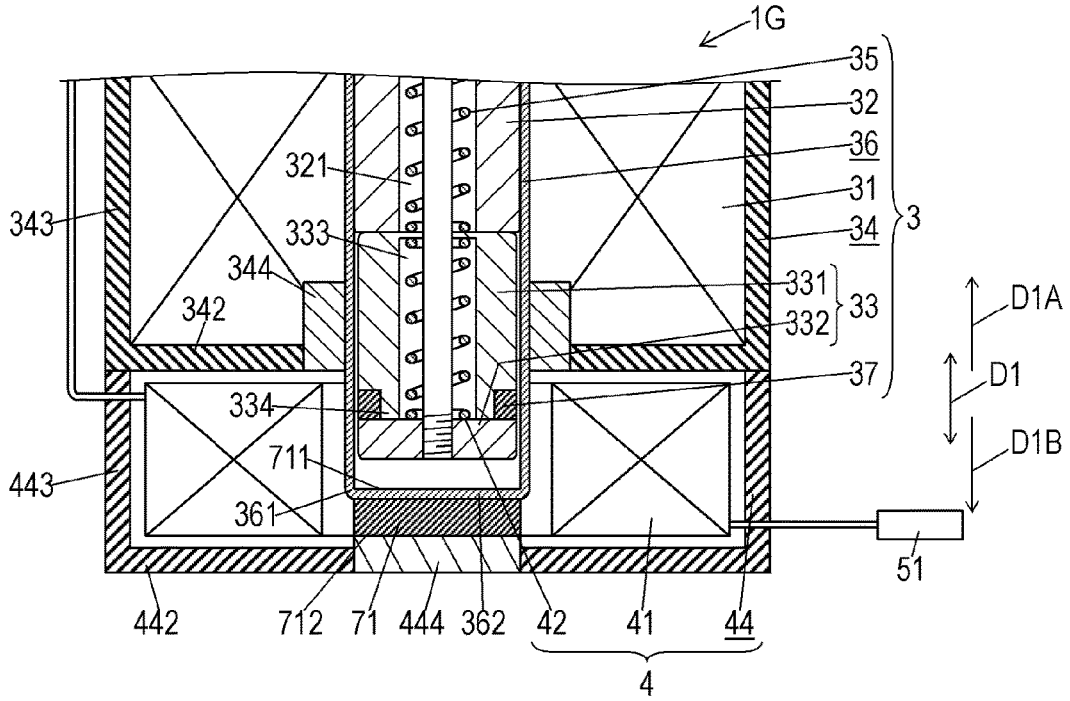
FIG. 11A is a schematic cross-sectional view of a main part of an electromagnetic relay in accordance with Exemplary Embodiment 2 in a normal time.
Figure 11B:
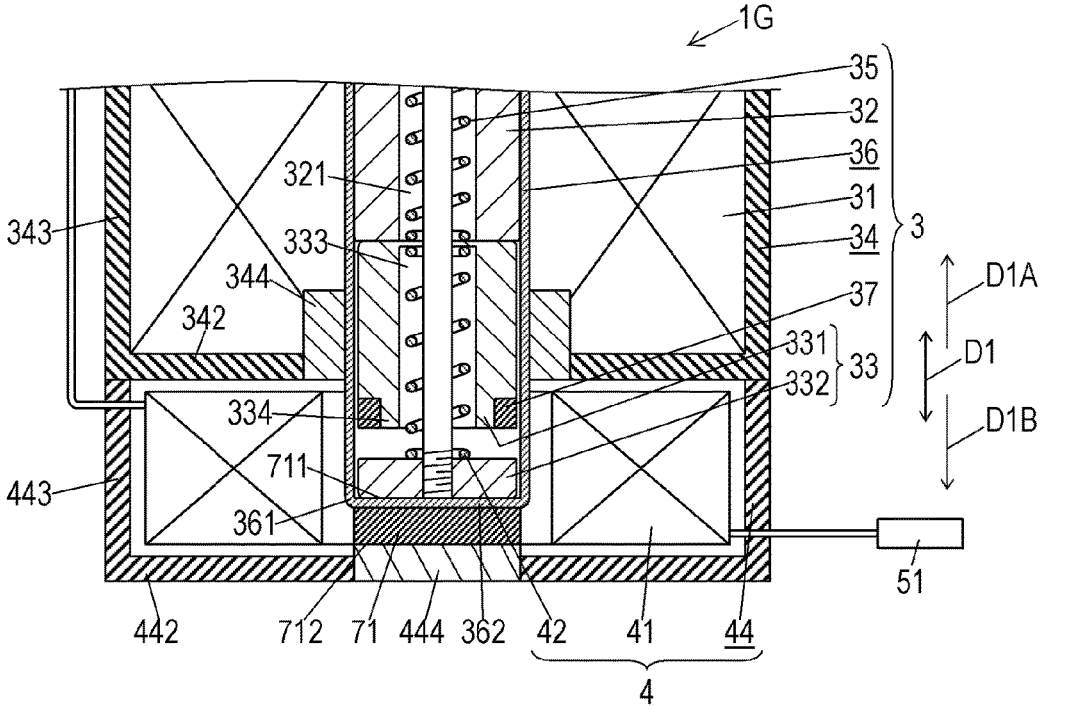
FIG. 11B is a schematic cross-sectional view of the principal part of the electromagnetic relay in accordance with Embodiment 2 while a trip device is activated.

FIGS. 11A and 11B are cross-sectional views of electromagnetic relay 1G in accordance with Exemplary Embodiment 2. In FIGS. 11A and 11B, components identical to those of electromagnetic relay 1 shown in FIGS. 1 to 6 are denoted by the same reference numerals. As shown in FIG. 11A, electromagnetic relay 1G further includes holding magnet 71.

In electromagnetic relay 1G in accordance with Embodiment 2, movable element 332 is disposed opposite to movable element 331 with respect to fixed element 32 in one direction (a longitudinal direction) out of upward and downward directions D1 in which fixed element 32 and movable element 331 are arranged. This configuration is the same as the relay in accordance with Embodiment 1. Holding magnet 71 is located opposite to movable element 332 with respect to movable element 331 in upward and downward directions D1. When a spring force caused by spring 42 moves movable element 332 in a direction away from movable element 331, holding magnet 71 attracts and holds movable element 332.

Holding magnet 71 will be detailed below. Holding magnet 71 is disposed between ferromagnetic core 444 and bottom plate 362 of tubular body 36. Holding magnet 71 is made of a permanent magnet having a disk shape and has magnetic pole surfaces 711 and 712 located on both ends thereof in a thickness direction (upward and downward directions D1) and having different polarities from each other. In accordance with the embodiment, magnetic pole surface 711 is an N pole and magnetic pole surface 712 is an S pole, but not limited to this configuration. The N pole and the S pole may be reversed. Holding magnet 71 has an outer diameter substantially identical to an outer diameter of ferromagnetic core 444.

Holding magnet 71, fixed element 32, movable element 331, and movable element 332 are arranged on a single straight line extending in upward and downward directions D1 (a longitudinal direction). Holding magnet 71 is disposed below movable element 332. Holding magnet 71 is disposed such that magnetic pole surface 711 serving as the upper surface of holding magnet 71 contacts bottom plate 362 of tubular body 36. Holding magnet 71 is disposed such that magnetic pole surface 712 serving as the lower surface of holding magnet 71 contacts ferromagnetic core 444. Holding magnet 71 is thus sandwiched between ferromagnetic core 444 and bottom plates 362.

When trip device 4 is activated and moves movable element 332 in the direction away from movable element 331, holding magnet 71 attracts movable element 332 and holds movable element 332 at the lower limit position, as shown in FIG. 11B. In other words, electromagnetic relay 1G in accordance with the present embodiment is configured to hold movable element 332 at the lower limit position by using the magnetic attraction force generated by holding magnet 71 after trip device 4 removes movable element 332 away from movable element 331. That is, once trip device 4 trips and moves movable element 332 to the lower limit position, holding magnet 71 holds or latches movable element 332 at the lower limit position.

Electromagnetic relay 1G in accordance with the present embodiment can hold movable element 332 at a position (the lower limit position) away from movable element 331 by using the magnetic flux generated by holding magnet 71 when trip device 4 is activated. After trip device 4 is activated and moves movable element 332 in the direction away from movable element 331, a rebound can be prevented, i.e., movable element 332 can be prevented from rebounding. As a result, when the abnormal current, such as overcurrent or a short-circuit current, flows into contactor 2, contactor 2 can be maintained in the open state more securely.

(2.2) Modifications

Figure 12A:
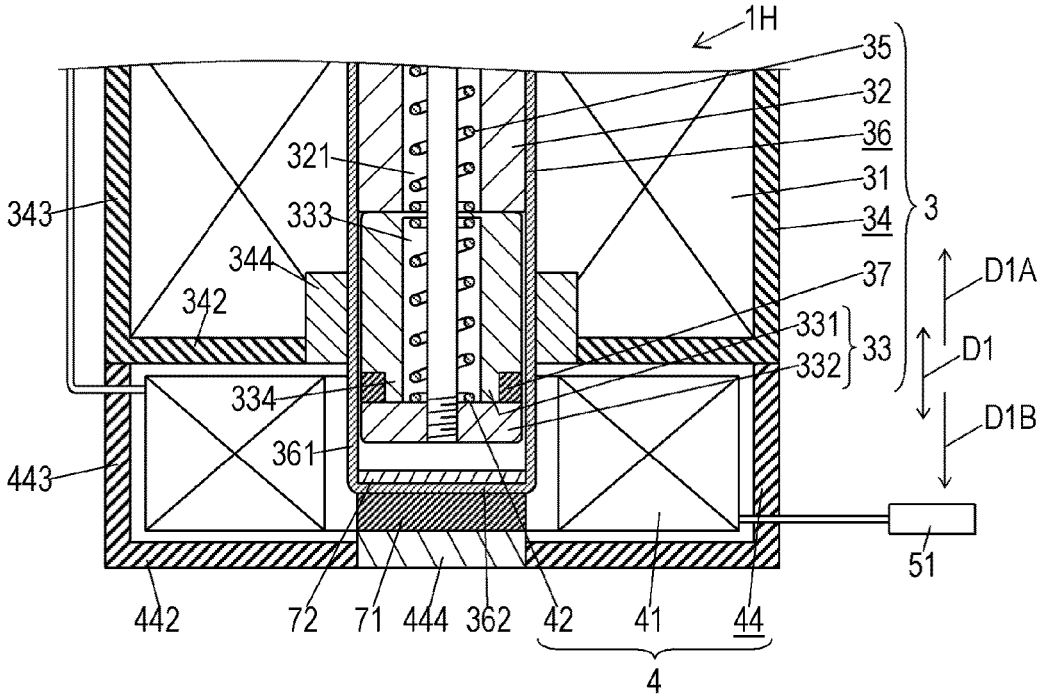
FIG. 12A is a schematic cross-sectional view of a main part of another electromagnetic relay in accordance with Embodiment 2.
Figure 12B:
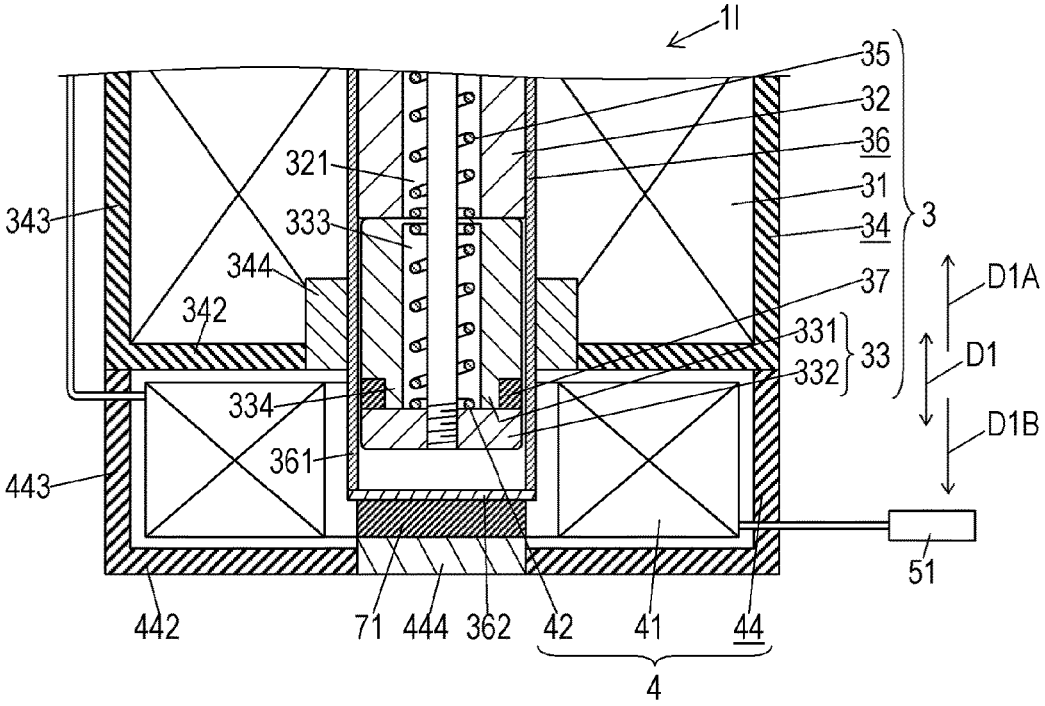
FIG. 12B is a schematic cross-sectional view of the main part of the electromagnetic relay shown in FIG. 12A.
Figure 12C:
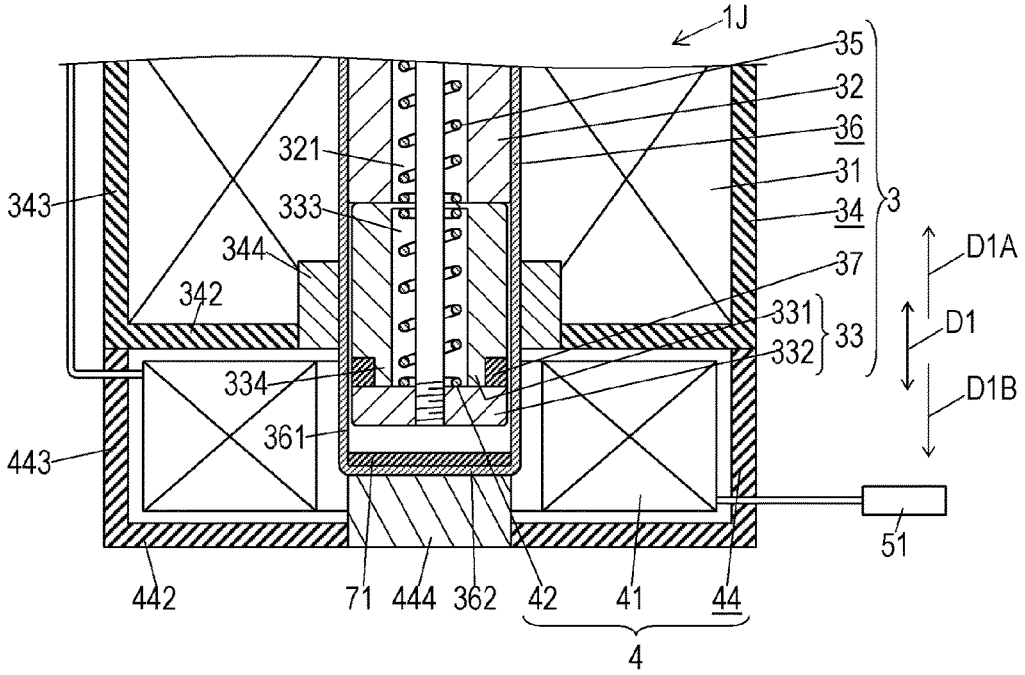
FIG. 12C is a schematic cross-sectional view of the main part of the electromagnetic relay shown in FIG. 12A.

FIGS. 12A, 12B, and 12C are cross-sectional views of another electromagnetic relay 1H, still another electromagnetic relay 1I, and further electromagnetic relay 1J in accordance with Embodiment 2, respectively. In FIGS. 12A to 12C, components identical to those of electromagnetic relay 1 in accordance with Embodiment 1 shown in FIGS. 1 to 6 and electromagnetic relay 1G shown in FIGS. 11A and 11B are denoted by the same reference numerals. Electromagnetic relays 1H to 1J are different from electromagnetic relay 1G shown in FIGS. 11A and 11B in the shape and arrangement of holding magnet 71. In other words, the shape and arrangement of holding magnet 71 are not limited to those of electromagnetic relay 1G shown in FIGS. 11A and 11B, but may be changed, for example, as shown in FIGS. 12A through 12C.

(2.2.1) Modification 1

Electromagnetic relay 1H shown in FIG. 12A further includes magnetic body 72 arranged with holding magnet 71 in upward and downward directions D1. Magnetic body 72 is magnetized by holding magnet 71. Electromagnet device 3 includes tubular body 36 accommodating movable elements 331 and 332 therein, similarly to electromagnetic relay 1 in accordance with Embodiment 1. Tubular body 36 includes tubular part 361 having a tubular shape having two openings and bottom plate 362 closing one of the two openings of tubular part 361. Movable elements 331 and 332 are disposed inside tubular part 361 and arranged in the longitudinal direction such that movable element 332 is located closer to bottom plate 362 than movable element 331 is. Magnetic body 72 is disposed inside tubular part 361 and between movable element 332 and bottom plates 362. In electromagnetic relay 1H shown in FIG. 12A, magnetic body 72 is made of magnetic material, and has a disc shape. Magnetic body 72 has an outer diameter substantially identical to an outer diameter of holding magnet 71. Magnetic body 72 is disposed such that a lower surface of magnetic body 72 contacts bottom plate 362 of tubular body 36.

In electromagnetic relay 1H, when generating an equivalent attraction force, holding magnet 71 can have a smaller size than the electromagnetic relay not including magnetic body 72. Since magnetic body 72 is disposed between holding magnet 71 and movable element 332, the magnetic flux between holding magnet 71 and movable element 332 is aligned by magnetic body 72, so that the attraction force from the holding magnet 71 acts on movable element 332 efficiently. In addition, no other members are disposed between magnetic body 72 and movable element 332. Therefore, the attraction force from holding magnet 71 acts on movable element 332 more efficiently. In this configuration, holding magnet 71 faces magnetic body 72 across bottom plate 362. Thus, holding magnet 71 is temporarily held on tubular body 36 by the magnetic attraction force generated between holding magnet 71 and magnetic body 72. Therefore, electromagnetic relay 1 can be assembled easily.

(2.2.2) Modification 2

Electromagnetic relay 1I shown in FIG. 12B is different from electromagnetic relay 1H shown in FIG. 12A in that at least one portion of bottom plate 362 constitutes a magnetic body functioning as magnetic body 72 of electromagnetic relay 1H shown in FIG. 12A. In electromagnetic relay 1I shown in FIG. 12B, the entirety of bottom plate 362, i.e., bottom plate 362 constitutes the magnetic body functioning as magnetic body 72 of electromagnetic relay 1H shown in FIG. 12A.

In electromagnetic relay 1I, a part of tubular body 36 of electromagnet device 3 serves as the magnetic body. Thus, the number of components can be reduced as compared with the case where a magnetic body is provided separately. Furthermore, since no other members are provided between bottom plate 362, serving as the magnetic body, and movable element 332, the attraction force from holding magnet 71 acts on movable element 332 efficiently. In the case that the magnetic body is constituted by the entirety of bottom plate 362, a nonmagnetic material is not located between holding magnet 71 and movable element 332. Therefore, the attraction force from holding magnet 71 acts on movable element 332 efficiently.

At least one portion of bottom plate 362 may constitute the magnetic body. The entirety of bottom plate 362 may not necessarily made of magnetic material. In other words, a portion of bottom plate 362 may be made of magnetic material, and the other portion of bottom plate 362 may be made of nonmagnetic material. Alternatively, not only bottom plate 362 of tubular body 36 but also a part or all of tubular part 361 may be made of magnetic material.

(2.2.3) Modification 3

Electromagnetic relay 1J shown in FIG. 12C is different from electromagnetic relay 1H shown in FIG. 12A in that holding magnet 71 is disposed inside tubular part 361 and between movable element 332 and bottom plates 362. Electromagnetic relay 1J does not include magnetic body 72 of electromagnetic relay 1H.

In other words, in electromagnetic relay 1J, holding magnet 71 is accommodated in tubular body 36 together with movable element 332. Holding magnet 71 is disposed such that magnetic pole surface 712 serving as the lower surface of holding magnet 71 contacts bottom plate 362.

In this configuration, no other members are interposed between holding magnet 71 and movable element 332. Thus, the attraction force from holding magnet 71 acts on movable element 332 efficiently. For that reason, holding magnet 71 may have a small size.

The configurations (including the modifications) described in accordance with the present embodiment may be combined with each structure described in accordance with Embodiment 1 (including the modifications) to be applied.

Exemplary Embodiment 3

Figure 13A:
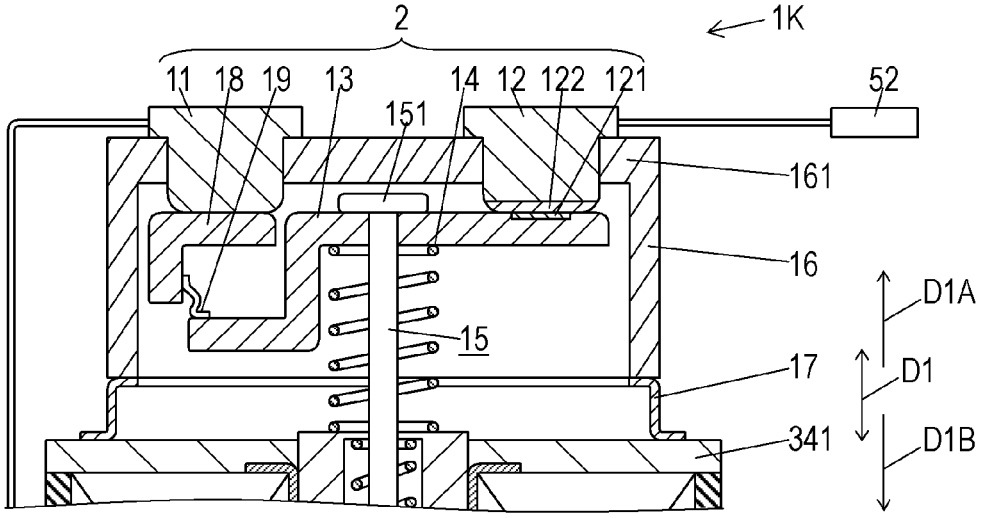
FIG. 13A is a schematic cross-sectional view of a main part of an electromagnetic relay in accordance with Exemplary Embodiment 3 in an ON state.
Figure 13B:
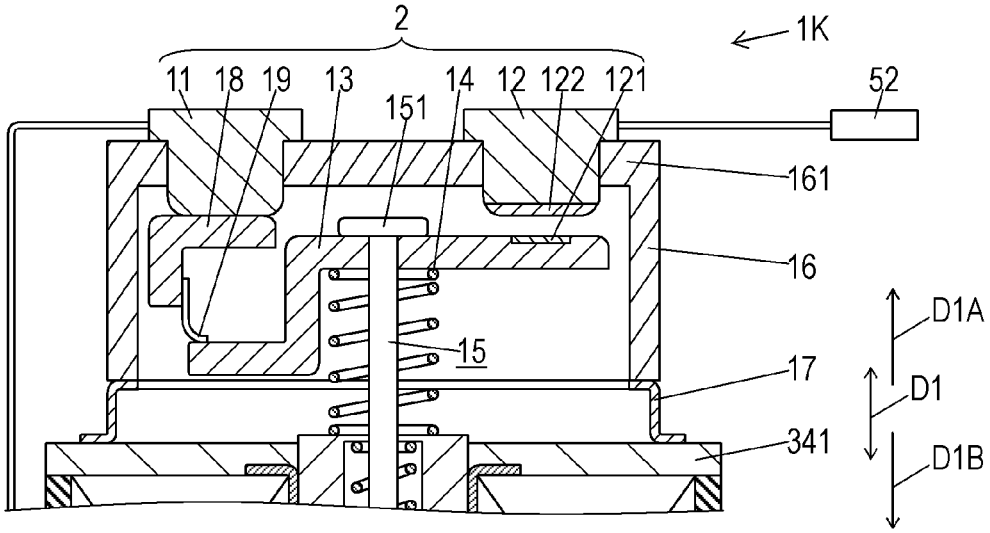
FIG. 13B is a schematic cross-sectional view of the principal part of the electromagnetic relay in accordance with Embodiment 3 in an OFF state.

FIGS. 13A and 13B are cross-sectional views of electromagnetic relay 1K in accordance with Exemplary Embodiment 3. In FIGS. 13A and 13B, components identical to those of electromagnetic relay 1 shown in FIGS. 1 to 6 are denoted by the same reference numerals. As shown in FIGS. 13A and 13B, electromagnetic relay 1K is different from electromagnetic relay 1 in accordance with Embodiment 1 in that contactor 2 includes none of fixed contact 22 and movable contact 21, i.e., includes fixed contact 122 constituted by a single contact point and movable contact 121 constituted by a single contact point. In other words, in electromagnetic relay 1 in accordance with Embodiment 1, contactor 2 has a double-break structure that includes a pair of fixed contacts 22 and 122 and a pair of movable contacts 21 and 121, whereas for electromagnetic relay 1K in accordance with Embodiment 3, contactor 2 has a single-break structure that includes single fixed contact 122 and single movable contact 121.

In electromagnetic relay 1K in accordance with Embodiment 3, terminal plate 18 is electrically and mechanically coupled to a lower end of one contact base 11 out of contact bases 11 and 12 in case 16. Terminal plate 18 is electrically connected to movable contact base 13 via braided wire 19.

In the normal time when abnormal current does not flow into contactor 2, i.e., in the state where trip device 4 is not activated, when electromagnetic relay 1 is in the ON state, movable contact 121 is located at the closed position where movable contact 121 contacts fixed contact 122, as shown in FIG. 13A. In the ON state, electromagnet device 3 pushes up shaft 15 in upward direction D1A. Thus, the spring force of contact-pressure spring 14 pushes up movable contact base 13 in upward direction D1A and places movable contact 121 at the closed position. At this moment, since contactor 2 is in the closed state, a current flows between contact bases 11 and 12 via terminal plate 18, braided wire 19, and movable contact base 13. Consequently, a current flows between the pair of output terminals 51 and 52.

On the other hand, in the normal time when the abnormal current does not flow into contactor 2, i.e., in the state where trip device 4 is not activated, when electromagnetic relay 1 is in the OFF state, movable contact 121 is placed at the open position away from fixed contact 122, as shown in FIG. 13B. In the OFF state, electromagnet device 3 pulls down shaft 15 in downward direction D1B. Thus, flange 151 of shaft 15 restricts movable contact base 13 to move in upward direction D1A, and places movable contact 121 at the open position away from fixed contact 122. At this moment, since contactor 2 is in the open state, a current does not flow between contact bases 11 and 12. Consequently, a current does not flow between output terminals 51 and 52.

When the abnormal current flows into contactor 2 and trip device 4 is activated, contactor 2 is turned into the open state, like the OFF state in the above-mentioned normal time, as shown in FIG. 13B.

The structures (including the modifications) described in accordance with the present embodiment may be combined with each structure described in accordance with Embodiment 1 (including the modifications) and each structure described in accordance with Embodiment 2 (including the modifications) to be applied.

In the above embodiments, terms, such as "upper surface," "lower surface," "upward direction," and "downward direction", indicating directions indicate relative directions determined only by a relative positional relationship of structural elements of the electromagnetic relays, and do but not indicate absolute directions, such as a vertical direction.

REFERENCE MARKS IN THE DRAWINGS

1 electromagnetic relay
2 contactor
21 movable contact
121 movable contact
22 fixed contact
122 fixed contact
3 electromagnet device
31 excitation coil (first excitation coil)
32 fixed element
331 movable element (first movable element)
332 movable element (second movable element)
334 magnetic-path portion
342 lower yoke plate (yoke)
36 tubular body
361 tubular part
362 bottom plate
37 permanent magnet
38 short-circuit prevention portion
4 trip device
41 excitation coil (second excitation coil)
42 spring
44 yoke (yoke block)
71 holding magnet
72 magnetic body
$\phi$1, $\phi$2 magnetic flux

The invention claimed is:

1. An electromagnetic relay comprising:

an electromagnet device including a first excitation coil, a fixed element, a first movable element, a second movable element, and a permanent magnet, wherein, while the permanent magnet causes the first movable element to attractingly contact the second movable element, the fixed element attracts the first movable element due to a magnetic flux generated by the first excitation coil so as to move the second movable element together with the first movable element from a normal position to an attracted position;

a contactor including a fixed contact and a movable contact, the movable contact being configured to move, as the second movable element moves, so as to switch between a closed state in which the movable contact contacts the fixed contact and an open state in which the movable contact is removed from the fixed contact, the contactor being turned into the closed state when the second movable element is located at the attracted position; and a trip device including a second excitation coil connected in series to the contactor and a spring for acting a force on the second movable element in a direction away from the first movable element, wherein, when the second movable element is located at the attracted position and an abnormal current equal to or larger than a predetermined value flows into the second excitation coil, the trip device releases the attracting contact of the second movable element by the permanent magnet by using a magnetic flux generated by the second excitation coil, and moves the second movable element by using the spring to turn the contactor into the open state.

2. The electromagnetic relay according to claim 1, wherein the permanent magnet is provided at the first movable element.

3. The electromagnetic relay according to claim 1, wherein the permanent magnet is provided at the second movable element.

4. The electromagnetic relay according to claim 1, wherein the electromagnet device further includes a magnetic-path portion that forms a closed magnetic path together with the first movable element and the second movable element, a magnetic flux generated in the permanent magnet passing through the closed magnetic path while the permanent magnet causes the first movable element to attractingly contact the second movable element.

5. The electromagnetic relay according to claim 4, wherein the magnetic-path portion is provided at the first movable element.

6. The electromagnetic relay according to claim 4, wherein the magnetic-path portion is provided at the second movable element.

7. The electromagnetic relay according to claim 4, further including a short-circuit prevention portion made of a non-magnetic material and provided between the permanent magnet and the magnetic-path portion.

8. The electromagnetic relay according to claim 1, wherein the second movable element is disposed opposite to the first movable element with respect to the fixed element in one direction in which the fixed element and the first movable element are arranged, the first movable element and the second movable element move in the one direction due to the magnetic flux generated by the first excitation coil, the trip device further includes a yoke that forms a part of a magnetic path through which the magnetic flux generated by the second excitation coil passes along a plane perpendicular to the one direction, the second movable element has a surface facing the first movable element when the second movable element is located at the attracted position, and the yoke projects from the surface of the second movable element opposite to the fixed element in the one direction.

9. The electromagnetic relay according to claim 1, wherein the trip device further includes a yoke block that forms a part of a magnetic path through which the magnetic flux generated by the second excitation coil passes, and the second excitation coil is wound around a part of the yoke block.

10. The electromagnetic relay according to claim 1, wherein the second movable element is disposed opposite to the first movable element with respect to the fixed element in one direction in which the fixed element and the first movable element are arranged, the electromagnetic relay further comprises a holding magnet provided opposite to the second movable element with respect to the first movable element in the one direction, and the holding magnet attracts the second movable element so as to hold the second movable element when a spring force caused by the spring moves the second movable element in a direction away from the first movable element.

11. The electromagnetic relay according to claim 10, further comprising a magnetic body arranged with the holding magnet in the one direction, the magnetic body being magnetized by the holding magnet, wherein the electromagnet device further includes a tubular body accommodating the first movable element and the second movable element therein, the tubular body includes a tubular part having a tubular shape having two openings and a bottom plate closing one of the two openings of the tubular part, the first movable element and the second movable element are disposed inside the tubular part and arranged in the one direction such that the second movable element is located closer to the bottom plate than the first movable element is, and the magnetic body is disposed inside the tubular part and between the second movable element and the bottom plate.

12. The electromagnetic relay according to claim 10, further comprising a magnetic body arranged with the holding magnet in the one direction, the magnetic body being magnetized by the holding magnet, wherein the electromagnet device further includes a tubular body accommodating the first movable element and the second movable element therein, the tubular body includes a tubular part having a tubular shape having two openings and a bottom plate closing one of the two openings of the tubular part, the first movable element and the second movable element are disposed inside the tubular part and arranged in the one direction such that the second movable element is located closer to the bottom plate than the first movable element is, and at least one portion of the bottom plate constitutes the magnetic body.

13. The electromagnetic relay according to claim 10, wherein the electromagnet device further includes a tubular body accommodating the first movable element and the second movable element therein, the tubular body includes a tubular part having a tubular shape having two openings and a bottom plate closing one of the two openings of the tubular part, the first movable element and the second movable element are disposed inside the tubular part and arranged in the one direction such that the second movable element is located closer to the bottom plate than the first movable element is, and the holding magnet is disposed inside the tubular part and between the second movable element and the bottom plate.

14. The electromagnetic relay according to claim 1, wherein the trip device maintains the attracting contact of the second movable element by the permanent magnet when the second movable element is located at the attracted position and a normal current smaller than the predetermined value flows into the second excitation coil.

* * * * *